US009085188B2

(12) United States Patent
Hasegawa

(10) Patent No.: US 9,085,188 B2
(45) Date of Patent: Jul. 21, 2015

(54) PRINTING APPARATUS AND INSPECTION METHOD

(71) Applicant: CANON KABUSHIKI KAISHA, Tokyo (JP)

(72) Inventor: Hiroaki Hasegawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/955,072

(22) Filed: Jul. 31, 2013

(65) Prior Publication Data

US 2014/0035993 A1 Feb. 6, 2014

(30) Foreign Application Priority Data

Jul. 31, 2012 (JP) ..... 2012-169432

(51) Int. Cl.
*B41J 2/165* (2006.01)
*B41J 29/393* (2006.01)

(52) U.S. Cl.
CPC ..... *B41J 29/393* (2013.01); *B41J 2/16579* (2013.01); *B41J 2/16517* (2013.01); *B41J 2029/3935* (2013.01)

(58) Field of Classification Search
CPC ..... B41J 2/16579
USPC ..... 347/23
See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,177,505 | A | 1/1993 | Sugiura et al. | |
| 5,532,799 | A | 7/1996 | Watanabe et al. | |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 6,631,975 | B2 * | 10/2003 | Fukasawa et al. | 347/33 |
| 7,050,751 | B2 | 5/2006 | Watanabe et al. | |
| 2003/0227505 | A1 | 12/2003 | Tanaka et al. | |
| 2005/0030327 | A1 * | 2/2005 | Tatsumi | 347/13 |
| 2005/0286742 | A1 * | 12/2005 | Rasmussen et al. | 382/112 |
| 2006/0164445 | A1 * | 7/2006 | Stadler | 347/2 |
| 2007/0237399 | A1 * | 10/2007 | Satonaga et al. | 382/225 |
| 2007/0256586 | A1 * | 11/2007 | Bonikowski et al. | 101/484 |
| 2009/0263020 | A1 * | 10/2009 | Hamasaki et al. | 382/181 |
| 2011/0279508 | A1 | 11/2011 | Naito | |
| 2012/0182566 | A1 * | 7/2012 | Sawano | 358/1.12 |
| 2013/0088541 | A1 | 4/2013 | Naito | |

FOREIGN PATENT DOCUMENTS

| | | |
|---|---|---|
| CN | 1374195 | 10/2002 |
| CN | 1468714 | 1/2004 |
| JP | 58-151844 | 9/1983 |

(Continued)

*Primary Examiner* — Shelby Fidler
(74) *Attorney, Agent, or Firm* — Fitzpatrick, Cella, Harper & Scinto

(57) ABSTRACT

The objective of the present invention is to provide a printing apparatus that can accurately determine stains that have occurred on the print surface during printing, and an inspection method employed for the printing apparatus. According to the present invention, the printing apparatus includes: a printing unit that forms an image on a print surface by ejecting ink from print heads based on image data; a reading unit that reads the print surface where the image is formed; and a determination unit that compares, with the image data, the read data obtained by the reading unit, and employs comparison results to determine stains that have occurred on the print surface.

11 Claims, 16 Drawing Sheets

(56) References Cited

FOREIGN PATENT DOCUMENTS

| | | |
|---|---|---|
| JP | H03-197140 | 8/1991 |
| JP | 04-141439 | 5/1992 |
| JP | 07-228025 | 8/1995 |
| JP | 2002-046260 | 2/2002 |
| JP | 2003-001835 | 1/2003 |
| JP | 2003-237157 | 8/2003 |
| JP | 4278885 | 6/2009 |
| JP | 2011-240492 | 12/2011 |
| JP | 2011-240493 | 12/2011 |

* cited by examiner

| FIG.5A | FIG.5B |
|---|---|

| FIG.9A | FIG.9B |
| --- | --- |

PRINTED PRODUCT WITH NO STAINS

PRINTED PRODUCT WHERE LINEAR STAIN HAS APPEARED

PRINTED PRODUCT WHERE STAINS ARE PRESENT AT INTERVALS

PRINTED PRODUCT WHERE INDETERMINATE STAIN HAS APPEARED

PRINTED PRODUCT THAT INCLUDES STAINS CAUSED BY FORMING BLANK AREA

PRINTED PRODUCT WHERE BOTH LINEAR STAIN AND STAINS FORMED AT INTERVALS HAVE APPEARED

PRINTING APPARATUS AND INSPECTION METHOD

BACKGROUND OF THE INVENTION

1. Field of the Invention

The present invention relates to a technique for detecting stains on a printed product.

2. Description of the Related Art

In a printer that prints a sheet by ejecting ink, ink may have inadvertently dripped from an ink ejection print head, and be attached to the sheet, or may be attached to a path in which the sheet is to be conveyed, thereby causing ink stains on the sheet. Therefore, printers that include a stain detection function and a recovery function are well known.

In Japanese Patent Laid-Open No. H03-197140 (1991), a printing apparatus equipped with a stain detection function is disclosed. The printing apparatus disclosed in the publication employs brightness information for a blank margin of a printed matter to detect the presence of stains. Specifically, the normal brightness of the blank margin is stored as a reference value, and each time the blank margin is detected, the brightness of the detected blank margin is compared with the normal brightness of the blank margin, and when a difference of the two exceeds a predetermined threshold value, it is ascertained that stains are present.

According to the printing apparatus disclosed in Japanese Patent Laid-Open No. H03-197140 (1991), the brightness information of a blank margin is employed to detect ink stains, which have occurred due to unexpected ejection of ink because of the defect of the apparatus, and stains that are originally attached to a printed product. However, the printing apparatus disclosed in Japanese Patent Laid-Open No. H03-197140 (1991) detects stains that have appeared in the blank margin, but can not detect stains in the other portions. That is, the stain occurred in the image can not be detected. Furthermore, the printing apparatus disclosed in Japanese Patent Laid-Open No. 03-197140 (1991) can determine only the presence of stains in the margin, but can not identify the type of stain, and therefore, a cause of the stain can not be specified based on the detection results.

Moreover, according to Japanese Patent Laid-Open No. H03-197140 (1991), after stains in the blank margin have been detected, the printing apparatus does not control a recovery process based on the detection results. Generally, in a case wherein stains that appear in a printed matter are those caused by the ink ejection unit of the printing apparatus, it is required that an appropriate recovery process be selected and performed from among a plurality of recovery processes for recovering the ejection function of the ink ejection unit. However, as described above, according to the printing apparatus disclosed in Japanese Patent Laid-Open No. H03-197140 (1991), since a user selects a recovery process to perform, there is a possibility that an incorrect recovery process may be performed. When the incorrect recovery process is performed, the condition would become worse, e.g., the range of the stain would be extended.

SUMMARY OF THE INVENTION

One objective of the present invention is to provide a method for accurately determining stains that have occurred on the printed face of a product.

In order to achieve this objective, a printing apparatus comprising: a printing unit configured to forming an image on a print surface by ejecting ink from print heads based on image data; a reading unit configured to read the print surface where the image is formed; and a determination unit configured to compare, with the image data, read data obtained by the reading unit, and employing comparison results to determine stains that have occurred on the print surface.

According to the present invention, the stains that have occurred on the printed surface during printing can be accurately determined.

Further features of the present invention will become apparent from the following description of exemplary embodiments (with reference to the attached drawings).

DESCRIPTION OF THE EMBODIMENTS

First Embodiment

A printing apparatus according to a first embodiment of the present invention is a high speed line printer that employs a long continuous sheet (a continuous sheet that is longer than a unit for printing that repeats in the conveying direction (this unit is called a page or a unit image)), and that is compatible with both one-sided printing and double-sided printing. This printing apparatus is appropriate for printing of a large volume of sheets at print labs, for example. In this specification, even when a plurality of small images, characters or blanks are included in an area of one unit of printing (one page), those elements included in the area are collectively called one unit image. That is, a unit image represents one unit of printing (one page) in a case wherein a plurality of pages are sequentially printed in continuous sheet. Further, the unit image may also be called simply an image. The length of the unit image differs depending on the image size to be printed. For example, for a 3R size photo, the length in the sheet conveying direction is 135 mm, and for an A4 size, the length in the sheet conveying direction is 297 mm. The present invention can be widely applied for printing apparatuses, such as printers, multi-functional printers, copy machines, facsimile machines, and various device manufacturing apparatuses, that form images by employing ink.

Figure 1:
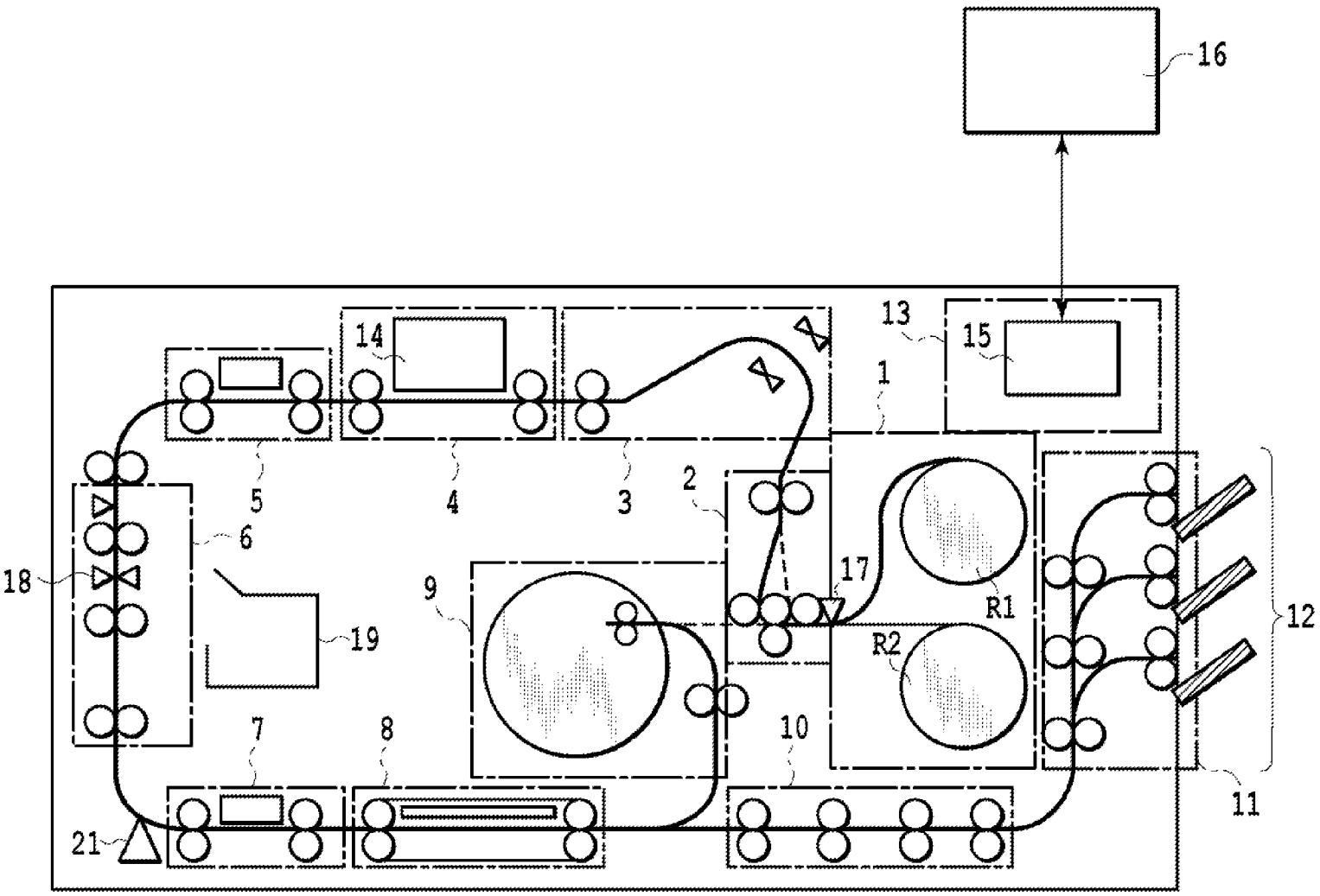
FIG. 1 is a schematic diagram illustrating the internal arrangement of a printing apparatus employed for first and second embodiments of the present invention.

FIG. 1 is a schematic cross-sectional view of the internal arrangement of a printing apparatus according to this embodiment. The printing apparatus can employ a sheet in a rolled shape, and perform double-sided printing on a first side of the sheet and a second side that is the reverse of the first side. The printing apparatus includes roughly, a sheet supply unit 1, a decurling unit 2, a positional deviation correction unit 3, a printing unit 4, an inspection unit 5, a cutter unit 6, an information printing unit 7, a drying unit 8, a sheet inversion unit 9, a delivery/conveying unit 10, a sorter unit 11, a discharging unit 12 and a control unit 13. The discharging unit 12 performs the sheet discharging process together with the sorter unit 11. A sheet is conveyed along a sheet conveying path, indicated by a solid line in FIG. 1, by a conveying mechanism that includes roller pairs and a belt, and is processed by the individual units. It should be noted that, at an arbitrary position along the sheet conveying path, the side close to the sheet supply unit 1 is called "upstream", and the opposite side is called "downstream".

The sheet supply unit 1 is a unit that holds the continuous sheet in a roll shape, and feeds the sheet. The sheet supply unit 1 can store two rolls R1 and R2, and pulls and supplies the sheet alternatively from the rollers. It should be noted that the number of rolls to be stored is not limited to two, and one, or three or more rolls may be stored. Further, so long as the sheet is continuous, the sheet type is not limited to a rolled sheet. For example, a continuous sheet provided with perforations at unit lengths may be prepared by being folded and laminated along the perforations, and be stored in the sheet supply unit 1.

The decurling unit 2 is a unit that reduces curls (warps) of the sheet supplied by the sheet supply unit 1. When the sheet passes by, the decurling unit 2 bends the sheet by employing two pinch rollers, with respect to one drive roller, and curls the sheet in the opposite direction, so that curls are to be reduced by the decurling force.

The positional deviation correction unit 3 is a unit that corrects positional deviation of the sheet that has passed the decurling unit 2 (the orientation of the sheet relative to the original traveling direction). Correction of the deviation of the sheet is performed by pressing reference sheet edges against guide members. The positional deviation unit 3 forms a loop for the sheet that is conveyed.

The printing unit 4 is a sheet processor that employs a print head unit 14 located above, and performs printing for the conveyed sheet to form an image thereon. That is, the printing unit 4 is a processor that performs a predetermined process for the sheet. The printing unit 4 also includes a plurality of conveying rollers to convey the sheet. The print head unit 14 has full-line inkjet print heads, for which a plurality of nozzles are arranged across the range that covers the maximum width of a sheet that is assumed to be employed. The print head unit 14 is provided by arranging a plurality of print heads in parallel in the conveying direction. In this embodiment, seven print heads are employed in consonance with seven colors, C (cyan), M (magenta), Y (yellow), LC (light cyan), LM (light magenta), G (gray) and K (black). It should be noted that the number of colors and the number of print heads are not limited to seven. The inkjet printing method can, for example, be a method employing heating resistors, a method employing piezoelectric elements, a method employing electrostatic elements, or a method employing MEMS elements. The inks of the individual colors are supplied from ink tanks through ink tubes to the print head unit 14.

The inspection unit 5 is a unit that employs a scanner to optically read a test pattern and an image that are printed on a sheet by the printing unit 4, and examines, for example, the nozzle states of the print heads, the sheet conveying condition and the position of the image to determine whether the image has been correctly printed. The scanner includes a CCD image sensor or a CMOS image sensor.

The cutter unit 6 is a unit that includes a mechanical cutter 18 that cuts off the printed sheet into a predetermined length. The cutter unit 6 also includes a cut mark sensor, which optically detects cut marks printed on the sheet, and a plurality of conveying rollers that are employed to feed the sheet to the following step. A garbage bin 19 is located near the cutter unit 6 in order to collect small sheet pieces that are cut off by the cutter unit 6 and are discharged as garbage. The cutter unit 6 has a sorting mechanism that determines whether the cut sheet should be discharged to the garbage bin 19, or should be moved to the original conveying path.

The information printing unit 7 is a unit for printing print-related information (inherent data), such as the serial number and the date of printing, on the non-printing area of the cut sheet. For printing this information, characters or codes are printed by employing print heads of inkjet type or thermal transfer type, for example. A sensor 21 that detects the leading edge of the cut sheet is provided upstream of the information printing unit 7 and downstream of the cuter unit 6. Based on the detection timing of the sensor 21, the time that the information printing unit 7 performs printing of information is controlled.

The drying unit 8 is a unit that heats the sheet printed by the printing unit 4, and dries the applied ink in a short period of time. The drying unit 8 blows hot air, from the bottom, on the sheet that passes by, and dries the ink applied face. It should be noted that the drying method is not limited to the method by which hot air is blown on the sheet, and may be a method whereby the surface of the sheet is irradiated by an electromagnetic wave, such as an ultraviolet ray or an infrared ray.

The sheet conveying path from the sheet supply unit 1 to the drying unit 8 is called a first path. The first path has a U-shaped portion from the printing unit 4 to the drying unit 8, and the cutter unit 6 is located along the U-shaped portion.

The sheet inversion unit 9 is a unit that temporarily winds the continuous sheet after printing for one side is completed, and inverts the sheet to perform double-sided printing on the reverse side. The sheet inversion unit 9 is arranged along a path (loop path) (called a second path) that is extended from the drying unit 8 via the decurling unit 2 to the printing unit 4 in order to supply again, to the printing unit 4, the sheet that has passed the drying unit 8. The sheet inversion unit 9 includes a winding rotary member (drum) that is rotated to wind the sheet. The continuous sheet that has been printed on one side and is not yet cut off is temporality wound around the winding rotary member. When the sheet has been wound, the winding rotary member is rotated reversely, and the sheet is fed in the reverse direction and is supplied to the decurling unit 2 and then to the printing unit 4. Since the sides of the sheet are reversed, the printing unit 4 can perform printing on the reverse side. Assuming that the sheet supply unit 1 is a first sheet supply unit, the sheet inversion unit 9 can be regarded as a second sheet supply unit. The double-sided printing operation will be described more in detail later.

The delivery/conveying unit 10 is a unit that conveys, to the sorter unit 11, the sheet that has been cut off by the cutter unit 6 and has been dried by the drying unit 8. The delivery/conveying unit 10 is provided along a path (called a third path) that differs from the second path where the sheet inversion unit 9 is located. A path switching mechanism that has a movable flapper is arranged at a path branch position (called a "delivery branch position") in order to selectively guide, either to the second path or to the third path, the sheet that has been conveying along the first path.

The discharging unit 12 that includes the sorter unit 11 is located on the side of the sheet supply unit 1 and at the terminal end of the third path. The sorter init 11 is a unit that sorts the printed sheets for the individual groups, as needed. The sorted sheets are discharged to a plurality of trays in the discharging unit 12. As described above for this layout, along the third path that is extended below the sheet supply unit 1, the sheet is discharged on the side, across the sheet supply unit 1, opposite the printing unit 4 and the drying unit 8.

As described above, the components, beginning from the sheet supply unit 1 till the drying unit 8, are arranged in order along the first path. The first path extended from the drying unit 8 branches to the second path and the third path. The sheet inversion unit 9 is located along the second path, and the second path extended from the sheet inversion unit 9 merges the first path. The discharging unit 12 is located at the terminal end of the third path.

The control unit 13 is a unit that controls the individual units of the printing apparatus. The control unit 13 includes a CPU, a storage device, a controller that includes various control units, an external interface, and an operating unit 15 employed by a user to enter input/output instructions. The operation of the printing apparatus is controlled based on an instruction issued by the controller, or a host apparatus 16, such as a host computer, that is connected to the controller via the external interface.

Figure 2:
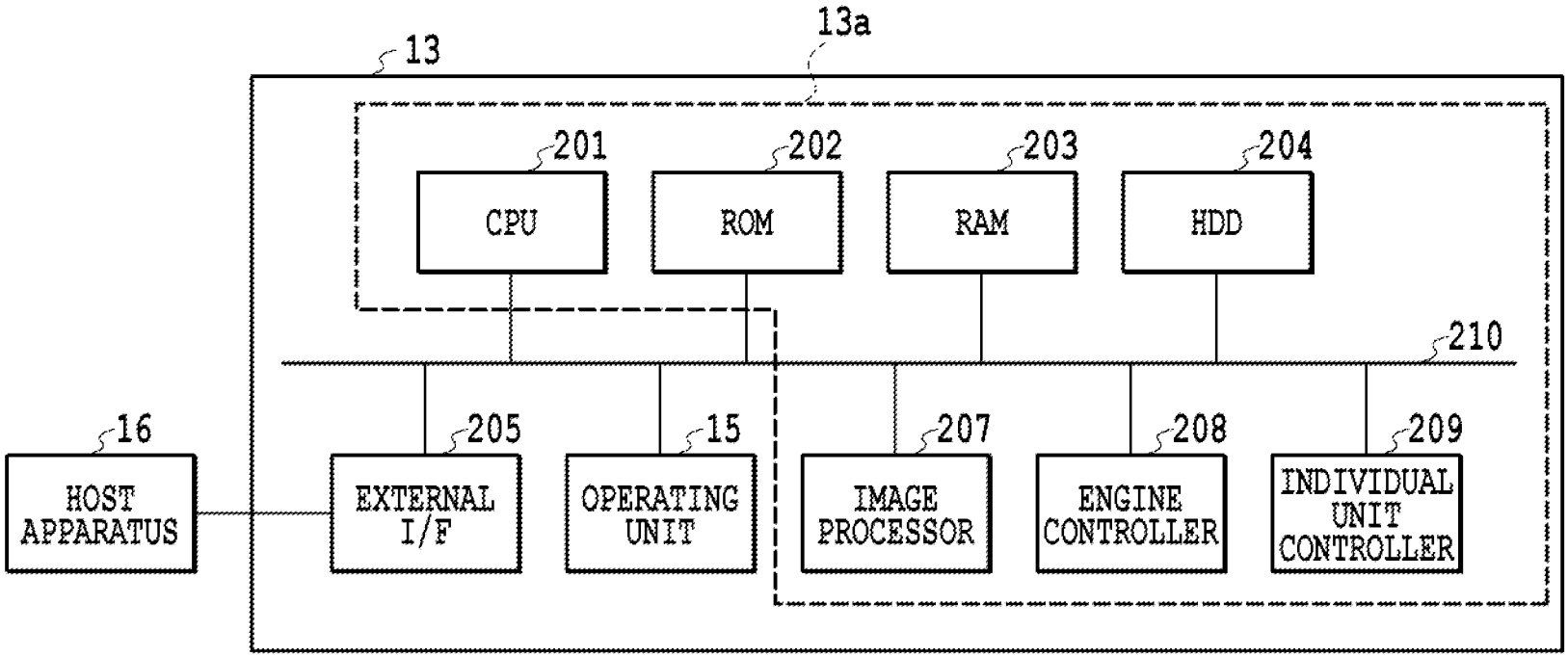
FIG. 2 is a schematic block diagram illustrating the arrangement of a control unit.

FIG. 2 is a block conceptual diagram illustrating the control unit 13. A controller 13*a* (a section enclosed by a broken line) of the control unit 13 includes a CPU (Central Processing Unit) 201, a ROM 202, a RAM 203, an HDD (Hard Disk Drive) 204, an image processor 207, an engine controller 208 and an individual unit controller 209. The CPU 201 performs general control for the operations of the individual units of the printing apparatus. The ROM 202 is employed to store programs executed by the CPU 201 and fixed data required for various operations of the printing apparatus. The RAM 203 is employed as a work area for the CPU 201, as a temporary storage area of various types of received data, or as an area to store various setup data. The HDD 204 can be employed for storing and retrieving programs executed by the CPU 201, print data, and setup information that is required for various operations of the printing apparatus. The operating unit 15 is an input/output interface with respect to a user, and includes input units, such as hardware keyboard and a touchscreen, and output units, such as a display device and an audio generator for presenting information.

Special processors are provided for the units for which fast data processing is required. The image processor 207 performs the image processing for print data handled by the printing apparatus. In the image processing, the color space (e.g., YCbCr) of input image data is converted into standard RGB color space (e.g., sRGB). Further, various other image processes, such as resolution conversion, image analysis and image correction, are performed for image data, as needed. The print data obtained through these image processes is stored in the RAM 203 or the HDD 204. The engine controller 208 receives a control command from the CPU 201, for example, and drives the print head unit 14 of the printing unit 4 based on print data. The engine controller 208 also controls the conveying mechanisms provided for the individual units of the printing apparatus. The individual unit controller 209 is a sub-controller that controls individually the sheet supply unit 1, the decurling unit 2, the positional deviation correction unit 3, the inspection unit 5, the cutter unit 6, the information printing unit 7, the drying unit 8, the sheet inversion unit 9, the delivery/conveying unit 10, the sorter unit 11 and the discharging unit 12. Based on an instruction issued by the CPU 201, the individual unit controller 209 controls the operations of the individual units. The external interface 205 is a local interface (I/F) or a network I/F to connect the controller 13*a* to the host apparatus 16. The components described above are interconnected by a system bus 210.

The host apparatus 16 serves as an image data supply source that permits the printing apparatus to perform printing. The host apparatus 16 may be either a general-purpose computer or a special computer, or may be a special image management apparatus, such as an image capture device, a digital camera or a photo storage device, that includes an image reader. When a computer is employed as the host apparatus 16, an OS, application software for creating image data and a printer driver for a printing apparatus are installed in the storage device of the computer. It should be noted that all of the above described processes need not always be performed by software, and one or all of the processes may be performed by hardware.

The basic printing operation of the printing apparatus in this embodiment will now be described. Since the printing operations differ in the single-sided printing mode and the double-sided printing mode, the operations in the individual modes will be described.

In the single-sided printing mode, the continuous sheet is fed by the sheet supply unit 1, and is processed by the decurling unit 2 and the positional deviation correction unit 3, and then, an image is printed on the obverse face (a first side) of the sheet by the printing unit 4. When an image having a predetermined unit length in the conveying direction (a unit image) is sequentially printed on the continuous sheet by the printing unit 4, a plurality of images are formed in the longitudinal direction of the sheet. The thus printed sheet is conveyed through the inspection unit 5 to the cutter unit 6, and is cut for each unit image. The obtained cut sheets are conveyed to the information printing unit 7, at which print-related information is printed on the reverse faces of the sheets, as needed. Thereafter, the cut sheets are conveyed, one by one, to the delivery/conveying unit 10, and are finally discharged to the discharging unit 12, and stacked on the sorter unit 11. Meanwhile, after the sheet has been cut along the last unit image, the continuous sheet that remains on the side of the printing unit 4 is returned to the sheet supply unit 1, and is rewound around the roll R1 or R2. As described above, in the single-sided printing mode, the sheet is conveyed along the first path and the third path, and does not pass the second path.

In the double-sided printing mode, the obverse face (the first side) printing sequence is performed, and sequentially, the reverse face (the second side) printing sequence is performed. In the first obverse face printing sequence, the operations beginning with the sheet supply unit 1 until the inspection unit 5 is the same as those performed in the single-sided printing mode described above. Thereafter, instead of cutting the sheet by the cutter unit 6, the continuous sheet is conveyed to the drying unit 8. After ink on the obverse face of the sheet has been dried by the drying unit 8, the sheet is guided not to the path (the third path) toward the delivery/conveying unit 10, but to the path (the second path) toward the sheet inversion unit 9. As the sheet is conveyed along the second path, the sheet is wounded around the winding rotary member of the inversion unit 9 that is rotated in the forward direction (in the direction counterclockwise in FIG. 1). When printing for the obverse face is completed by the printing unit 4, the continuous sheet is cut by the cutter unit 6 along the trailing edge of the printing area. Thereafter, the continues sheet portion located downstream in the conveying direction with respect to the cutting position as a reference, i.e., the sheet portion that has been printed is conveyed via the drying unit 8, and is wound by the sheet inversion unit 9 until the trailing edge (the cut portion) reaches the sheet inversion unit 9. When the winding by the sheet inversion unit 9 has started, the continuous sheet that remains upstream in the conveying direction with respect to the cutting position, i.e., the continuous sheet that is located on the side of the printing unit 4, is returned to the sheet supply unit 1, and is rewound around the roll R1 or R2, so that the leading edge of the sheet (the cut portion) will not stay at the decurling unit 2. Since the sheet is returned in this manner (back-feeding), a collision with the sheet that is to be supplied again in the reverse face printing sequence can be avoided.

When the obverse face printing sequence has been performed, the operating mode is changed to the reverse face printing sequence. The winding rotary member of the sheet inversion unit 9 is rotated in the reverse direction (the clockwise direction in FIG. 1). The sheet that has been rewound (the trailing edge of the sheet during rewinding becomes the leading edge of the sheet when feeding) is supplied to the decurling unit 2 along the path indicate by a broken line in FIG. 1. The decurling unit 2 removes curls applied to the sheet by the winding rotary member. That is, the decurling unit 2 is located along the first path between the sheet supply unit 1 and the printing unit 4, and along the second path between the sheet inversion unit 9 and the printing unit 4, and serves as a unit in common that decurls the sheet that is conveyed along either path. The sheet that has been inverted is conveyed via the positional deviation correction unit 3 to the printing unit 4, and images are printed on the reverse face of the sheet. The thus printed sheet is conveyed via the inspection unit 5 to the cutter unit 6, and is cut by a predetermined unit length that is designated in advance. Since images are printed on the obverse and reverse sides of the individual cut sheets, printing by the information printing unit 7 is not performed. The cut sheets are conveyed, one by one, to the drying unit 8, and thereafter, discharged, via the delivery/conveying unit 10, to the discharging unit 12 and stacked on the sorter unit 11. As described above, in the double-sided printing mode, the sheet is processed by being conveyed along the first path, the second path, the first path and the third path in this order. It should be noted that the above described printing sequence is not limited to the processing for cutting the sheet by the cutter unit and discharging the obtained cut sheets one by one to the discharging unit. For example, instead of cutting the sheet, the printed continuous sheet may be wounded around a roll.

Next, "stains", defined in this embodiment, that appear on the sheet will be described by employing FIGS. 11A to 11F and FIGS. 12, 13A and 13B.

Figure 12:
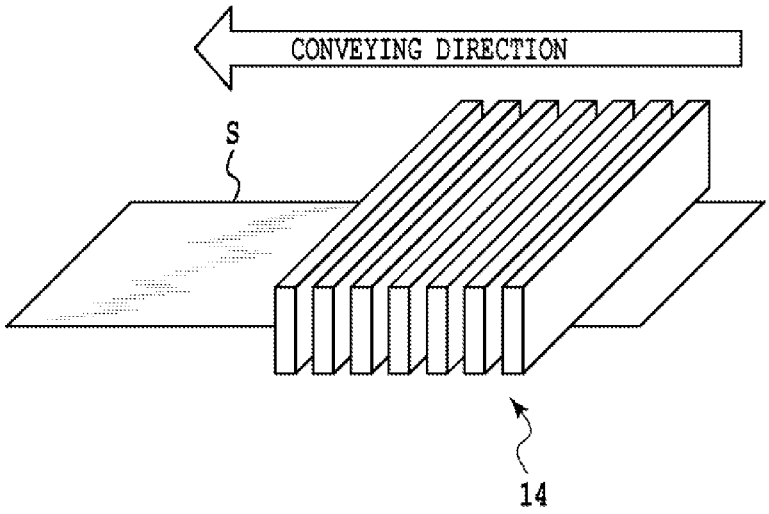
FIG. 12 is a schematic diagram showing the arrangement of a print head unit.

The "stains" described here represents ink that is attached, due to an ink ejection defect of the print head unit 14, to the portions of a targeted sheet where ink must not be ejected, i.e., ink that is attached to unexpected portions of the sheet. The types of "stains" defined in this embodiment will be described later. In this embodiment, the CPU 201 (see FIG. 2) permits the print head unit 14 to eject ink to the positions of the sheet where ink droplets should land. In the printing apparatus for this embodiment, the sheet is conveyed relative to the print head unit 14, as shown in FIG. 12. In this state, ink is ejected, to the surface of the conveyed sheet, from the ends (ejection ports) of ink ejection portions (also called nozzles), which are provided for the individual print heads of the print head unit 14, and printing is performed.

Figure 13A:
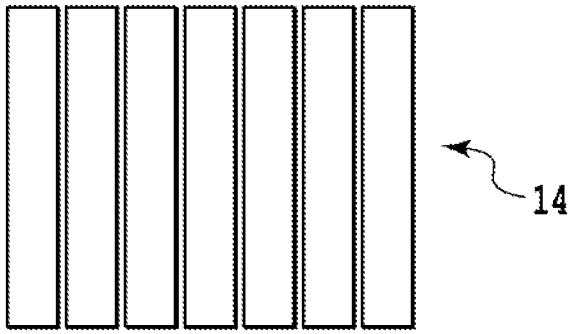
FIG. 13A is a bottom view of the print head unit, taken from the ink ejection face thereof.
Figure 13B:
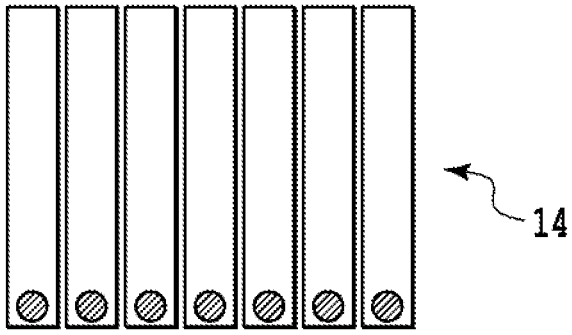
FIG. 13B is a diagram showing the abnormal portions of the ejection face when stains have occurred by dripping ink.

FIG. 13A is a diagram showing the face of each print head, included in the print head unit 14, where ejection ports are formed in a case wherein the printing operation is normally performed. As shown in FIG. 13A, in a case wherein the printing operation is normally performed, ink is not attached to the ejection faces of the print heads, and ejection of ink is appropriately performed. On the other hand, in a case wherein a defect for the ink ejection portion has occurred, stains are produced on the ejection faces. An example defect of the ink ejection face is so-called ink blot dripping, a phenomenon that ink inadvertently drips from the ink ejection faces. The ink blot dripping is a phenomenon that ink is absorbed and remains in paper dust that is attached near the ejection ports of the ink ejection portion, and is finally dropped as a blot from the ejection face by its own weight. There is another case wherein a defect occurs when the CPU 201 controls the amount of ink ejected from the ink ejection portions, and conveying of the sheet is continued while ink is bleeding from the printed product. In this case, the bleeding ink may be attached to the sheet conveying path, or the printed portion may be conveyed without being completely dried and ink may be attached to the sheet conveying path, and as a result, stains appear on the sheet.

The printing apparatus for this embodiment includes a recovery unit that performs the recovery process for the print head unit 14 when such stains appear on the sheet. The recovery process is a process for maintaining or recovering the ejection function of the ink ejection portions of the print head unit 14 in order to remove or reduce a clog or a blot of ink at the ink ejection portions of the print head unit 14. The recovery process includes, for example, preliminary ejection for ejecting (discharging) ink via the ink ejection portions to remove clogging, and suction-based recovery for drawing ink, by suction, from the ink ejection portions in order to obtain the same effects as described above. Further, a cleaning process for employing a blade, for example, to remove ink that is attached on the ejection faces of the print heads of the print head unit 14 is also another recovery process. The recovery processes are not limited to those processes, and another process that provides the same effects may also be employed. For example, instead of the suction-based recovery process, a pressure-based recovery process can be employed, in which the positive pressure is applied to the print heads to forcibly discharge ink from the ejection ports.

Figure 11A:
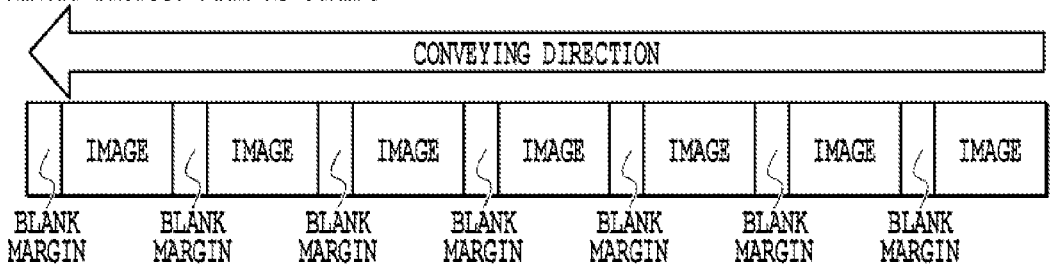
FIGS. 11A to 11F are diagrams showing the types of stains that have appeared in a printed matter.

FIGS. 11A to 11*f* are diagrams showing the state of a printed matter that can be obtained by the printing apparatus of this embodiment. FIG. 11A is a diagram showing the state in which the printing operation has been appropriately performed by the print heads where no stains are present on the ejection faces, as shown in FIG. 13A, and a normal printed product without ink stains can be obtained. For the printed product in FIG. 11A, a print pattern where an image and a blank are repetitively arranged in order of an image, a blank, an image, a blank, . . . is printed. An image here represents a unit image, and data employed to form the image is binary data that is bitmapped in the RAM 203 or the HDD 204, and this bitmap data is hereinafter referred to as print data.

FIGS. 11B to 11F are diagrams showing example stains that appear on the printed products. In this embodiment, stains are defined by being categorized into three types shown in FIGS. 11B, 11C and 11D, and stains other than stains attached along the conveying path and stains caused by ink blots, which will be described later, are regarded as indeterminate stains.

Figure 11B:
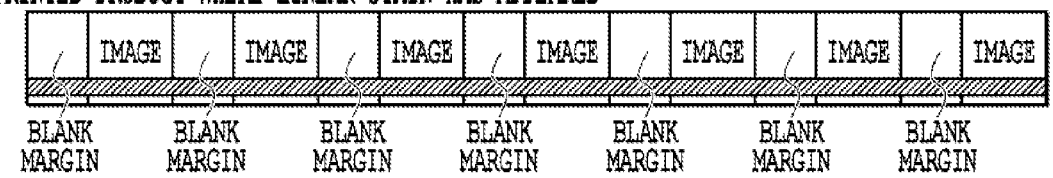

FIG. 11B is a diagram showing a printed matter in a case wherein stains occurred along the conveying path indicated by a solid line in FIG. 2, and were attached to the printed matter. The conveying path here is a path provided to convey the sheet from the sheet supply unit 1 to the discharging unit 12. This type of stain is a stain, as shown by a black portion in FIG. 11B, that is linearly extended in the longitudinal direction of the sheet. This stain can not be removed by performing the recovery process for the print head unit 14. As previously described, the recovery process for this embodiment is a process for discharging ink from the ink ejection portions of the print head unit 14, and for wiping the ejection faces, and is not a process for removing stains from the conveying path. The recovery process performed for the print head unit 14 includes a process for ejecting ink to the sheet (performing preliminary ejection), while conveying the sheet. Therefore, when the recovery process for the print head unit 14 is performed, there is a possibility that the stains on the sheet may be attached to another portion of the conveying path. That is, there is a possibility that as the sheet is conveyed, ink stains attached to one part of the conveying path will be expanded to the entire conveying path, and the succeeding printed matter will rub against the smudged conveying sheet, and the same problem will occur.

Figure 11C:
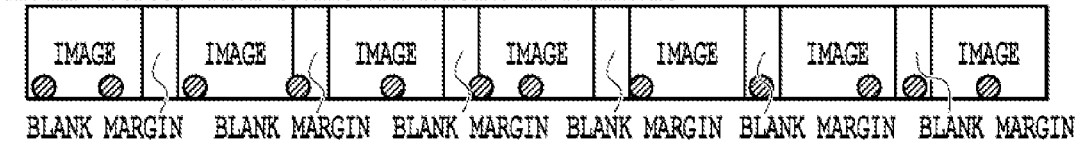

The second stain type is stains as shown in FIG. 11C that are caused by dripping a blot of ink from the ink ejection portions of the print head unit 14. It is believed that the cause of the stains is the portions indicated by black circles in FIG. 13B. Depending on the moisture conditions or dried conditions of ink and the ink ejection portions, ink may not be normally ejected from the ink ejection portions, and ink is retained in the ink ejection portions and the paper dust attached at the ink ejection portions, and is inadvertently dropped by its own weight. The blots of ink become ink stains that appear at the intervals, as shown in FIG. 11C. The occurrence of this type of stains can be avoided by performing the recovery process of this embodiment for the ink ejection portions of the print head unit 14. Therefore, when the recovery process for the print head unit 14, i.e., the preliminary ejection, the wiping process and the suction-based recovery process are performed, the occurrence of stains can be removed, or reduced.

Figure 11D:
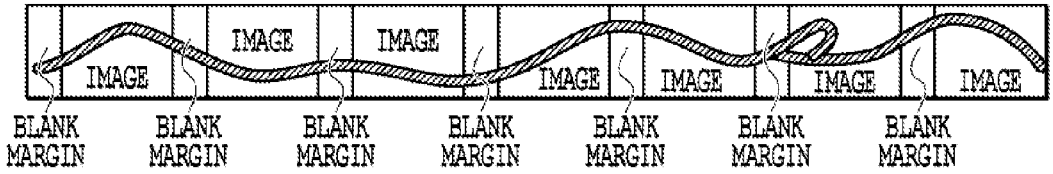

The third type of stains is an indeterminate stain shown in FIG. 11D. For this stain, various causes (e.g., a warped conveying path, ink blot dripping, a smudged conveying path, or a stain originally present on a sheet) are available, and it is difficult to determine the cause of the stain. Therefore, in this embodiment, this type of stain is regarded as an indeterminate stain. Since the cause of the stain is not obvious, the stain can not be removed by performing the above described recovery process for the print head unit 14.

Figure 11E:
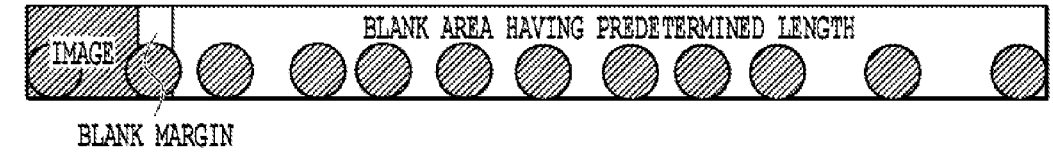

The stain shown in FIG. 11E is an example, for which the stain type can not be identified in a case wherein such a stain is formed on the normal printed pattern, but can be identified as an ink blot stain in a case wherein a white blank area is printed for a predetermined length. Specifically, this is referred to a case wherein an image is a pattern consisting of one color, black, and the color of ink stains is also black. In this case, as will be described later, stains that have occurred in the blank margin can be detected, but a stain that appears on an image can not be detected. Furthermore, even when a stain that appears on the margin can be detected, it can not be identified whether the stain is linearly extended, or the stains are present at the intervals. That is, in a case wherein a linearly extended stain is present on a normal print pattern, which is provided by repetitively arranging an image portion and a blank margin portion, the presence of the stain can not be identified for the image portion, and is identified only for the blank margin portion. Therefore, it is impossible to determine whether the stain detected for the blank margin portions is linearly extended to the image portions, or whether a portion without stains exists between the blank margin portion and the image portion, in both of which the stains are present. On the contrary, while referring to the example in FIG. 11E, when a print pattern having a blank area of a predetermined length is designated, and detection of stains for this area is performed, the shape of a stain can be identified. According to the example in FIG. 11E, it can be determined that the stains formed in the margin are those caused by dripping of inkblots. It should be noted that the print patterns are not limited to those shown in FIGS. 11A to 11F. For example, a print pattern that provides a printed matter having no margins, i.e., a printed pattern consisting of only image portions, can also be employed.

Next, the operating process sequence based on a printing schedule will now be described in order to explain a stain detection method according to this embodiment. In the printing apparatus of this embodiment, as described above, the inspection unit 5 in FIG. 1 is arranged downstream near the print head unit 14 in the sheet conveying direction. Therefore, when an image has been formed on the sheet by ejecting ink from the print head unit 14, the image portion of the sheet can be optically read to examine the image on the sheet. The inspection unit 5 of this embodiment employs an image sensor, such as a CCD, to read the image that is printed by the print head unit 14 located at the previous stage, and generates binary bitmap data (read image data). The generated image data is stored in the RAM 203 or the HDD 204.

Figure 3:
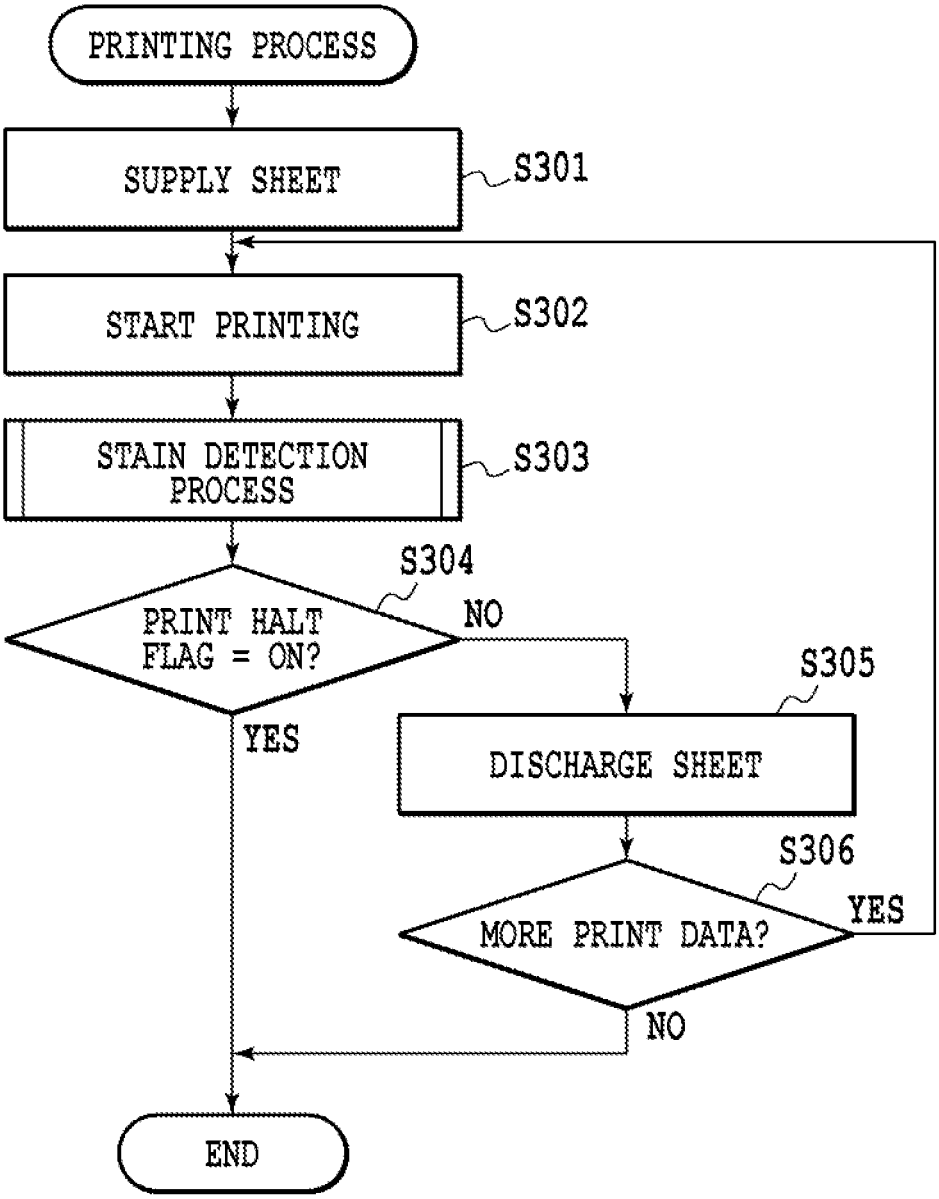
FIG. 3 is a flowchart showing a process sequence of a printing operation.

FIG. 3 is a flowchart showing the general process sequence for the printing operation controlled by the control unit 13 in this embodiment. At step S301, based on a printing instruction, the sheet supply unit 1 supplies the sheet to perform printing. At step S302, the print head unit 14 starts printing on the sheet to be printed. The printing performed at this time is forming of an image and a cut mark on the sheet.

At step S303, the inspection unit 5 is employed to perform stain detection. The stain detection process is performed by determining, as described above, whether a printed portion is present in the area of the printed product where ink should not be ejected, and whether an image that differs from an image that should be printed has been printed. For example, nothing should be printed in a blank margin area; however, when a printed portion exists in the blank margin portion, it can be determined that the printed portion is a stain. Further, as for an image portion, a difference is obtained between image data employed to print a normal image and image data obtained by reading the printed image, and when the difference is equal to or greater than a predetermined value, it is determined that a stain is present in the image portion. The stain detection process will be described more in detail later by employing a stain detection flowchart in FIGS. 4A and 4B. The detected stain determination process is handled by the controller 13*a* (determination unit). The determination unit compares image data employed to print an image with image data obtained by the inspection unit 5 (the image reading unit) through reading of the image forming face of the sheet, and employs the shape of the stain portion to determine the stain type.

At step S304, as for the stains on the sheet that has been detected by performing the stain detection process at step S303, a check is performed to determine whether the recovery process has been performed to remove the cause of the stain. Specifically, a check is performed to determine whether a print halt flag (FLAG) has been set on (ON) in order to determine whether the printing operation should be halted for the stain detection process that will be described later. When the print halt FLAG is ON, it is assumed that stains have been detected, and that recovery process for removing the cause of the stain is not yet performed, and the printing operation should be halted.

When the print halt FLAG is in the off state (OFF), it is assumed that no stains are detected, or that stains were detected, but the cause of stains is already removed. For the determination at step S304, the print halt FLAG is examined to determine whether it is ON or OFF. When the determination results at step S304 indicate NO, i.e., when the print halt FLAG is OFF, there is more print data to be printed, and stains are not detected, or the cause of stains is removed. Therefore, since the condition will not be deteriorated even when the printing operation is continued, the sheet discharging operation is performed at step S305. Following this, at step S306, a check is performed to determine whether there is more print data to be printed. When the determination result is Yes, i.e., when the print halt FLAG is ON, it is assumed that stains are detected, and the cause of the stains is not yet removed. Since there is a possibility that the stains will be expanded to deteriorate the condition, it is determined that the printing operation should not be performed at this time. Further, since there is also a possibility that the performance of the sheet conveying operation will expand the stains, the processing is terminated without discharging of the sheet.

The sheets discharged at step S305 are those for which printing is completed, and which are obtained when the roll shaped sheet is cut into individual sheets by the cutter unit 6. However, as described above, instead of being cut, the continuous sheet may also be discharged.

Furthermore, when more data to be printed are present after the sheets have been discharged, the printing should be continued. Therefore, at step S306, a check is performed to determine whether print data are still present, and in a case wherein there is no more print data, i.e., the determination result is No, it is assumed that printing of all of the data has been completed, and thereafter, the printing operation is ended and the processing is terminated. When the determination result is Yes, program control returns to step S302, and the printing operation is continued. The above described process sequence is employed to perform the printing operation.

The stain detection process for this embodiment will now be described by employing FIGS. 4A and 4B, 6, 7, 8 and 10 and FIGS. 11A to 11F.

First, the stain detection process for this embodiment will be described while referring to the flowchart in FIGS. 4A and 4B.

In this embodiment, a print pattern is formed by repetition of an image and a blank margin, and the stain detection process should be changed for a blank margin and an image. Therefore, at step S401 in FIGS. 4A and 4B, first, a check is performed to determine whether a portion currently examined is a blank margin portion or an image portion. In this inspection process, an image sensor provided for the inspection unit 5 in FIG. 2 is employed to read the printed face of the sheet. When it is ascertained that the portion currently examined is a blank margin portion, program control advances to the stain detection process for a blank margin portion. When the currently examined portion is not a blank margin portion, it is assumed that the pertinent portion is an image portion, and the stain detection process for the image portion is performed. That is, when the determination result at step S401 is Yes, the portion currently examined is a blank margin portion, and program control advances to step S402 for the blank margin stain detection process. When the determination result at step S401 is No, the portion currently examined is an image portion, and program control moves to step S409.

Figure 6:
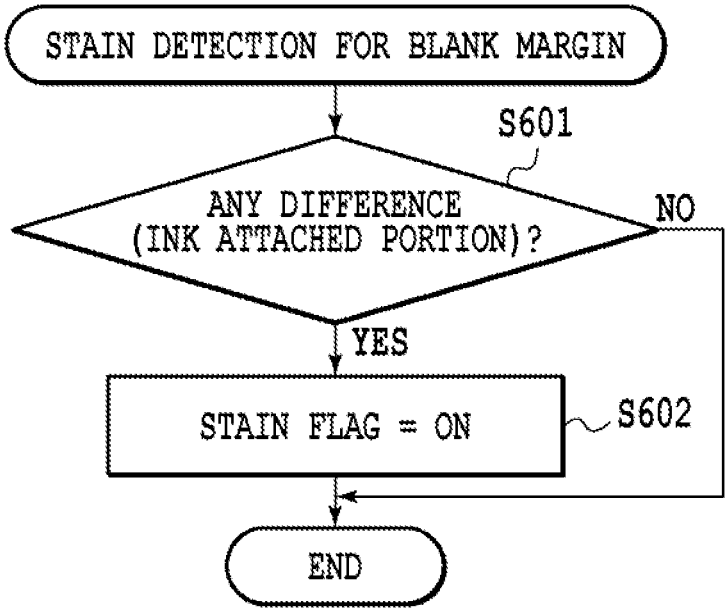
FIG. 6 is a flowchart showing the processing for detecting stains on a blank margin.

At step S402, a detection process for examining whether stains are present in the blank margin portion is performed. The blank margin portion is a portion where no printing is performed, i.e., ink is not applied. Therefore, in a case wherein a portion where ink is applied is detected in the blank margin portion by the inspection unit 5, it can be ascertained that the pertinent portion is a stain. FIG. 6 is a flowchart showing this detection process. In this flowchart, first, at step S601, a check is performed to determine whether a portion where ink is applied is present in a blank margin portion. When the determination result is Yes, i.e., when an ink attached portion is detected, program control advances to step S602 to set a stain FLAG to the ON state, and thereafter, moves to step S403 in FIGS. 4A and 4B. The stain FLAG is a FLAG to store information as to whether stains are detected. When the determination result at step S601 is No, i.e., when no ink attached portion is detected, it is assumed that stains are not present, and the processing in FIG. 6 is terminated, and thereafter, program control moves to step S403 in FIGS. 4A and 4B.

Figure 7:
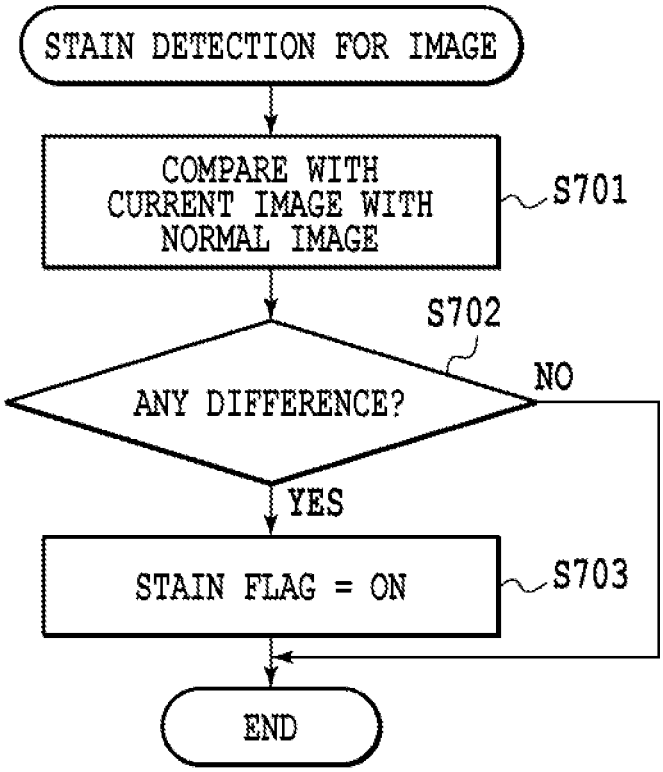
FIG. 7 is a flowchart showing the processing for detecting stains on an image.

Referring again to FIGS. 4A and 4B, at step S409, the process for detecting ink stains attached to an image portion is performed. FIG. 7 is a flowchart showing the ink stain detection process performed for an image portion.

At step S701 in FIG. 7, an image actually printed is compared with an original image to be printed, and a check is performed to determine whether there is a difference between the two images. Specifically, exclusive OR operation is performed between binary print data for an original image to be printed and binary print data (read data) obtained by reading the actually printed image. The result obtained by using exclusive disjunction is employed to determine whether there is a difference in the two images. The determination process is performed at step S702.

In a case wherein the determination whether there is a difference between the two images is performed at step S702, and the determination result is Yes, it is assumed that there is a difference between the original image to be printed and the actually printed image, and it can be ascertained that some type of stains are present. Therefore, at step S703, the above described stain FLAG is set ON, and thereafter, program control moves to step S403 in FIGS. 4A and 4B. In a case wherein the determination result at step S702 is No, i.e., in a case wherein there is no difference between the image to be printed and the actually printed image, it can be ascertained that no stains are detected. Therefore, the processing in FIG. 7 is terminated, and program control moves to step S403 in FIGS. 4A and 4B.

Figures 4, 4A:
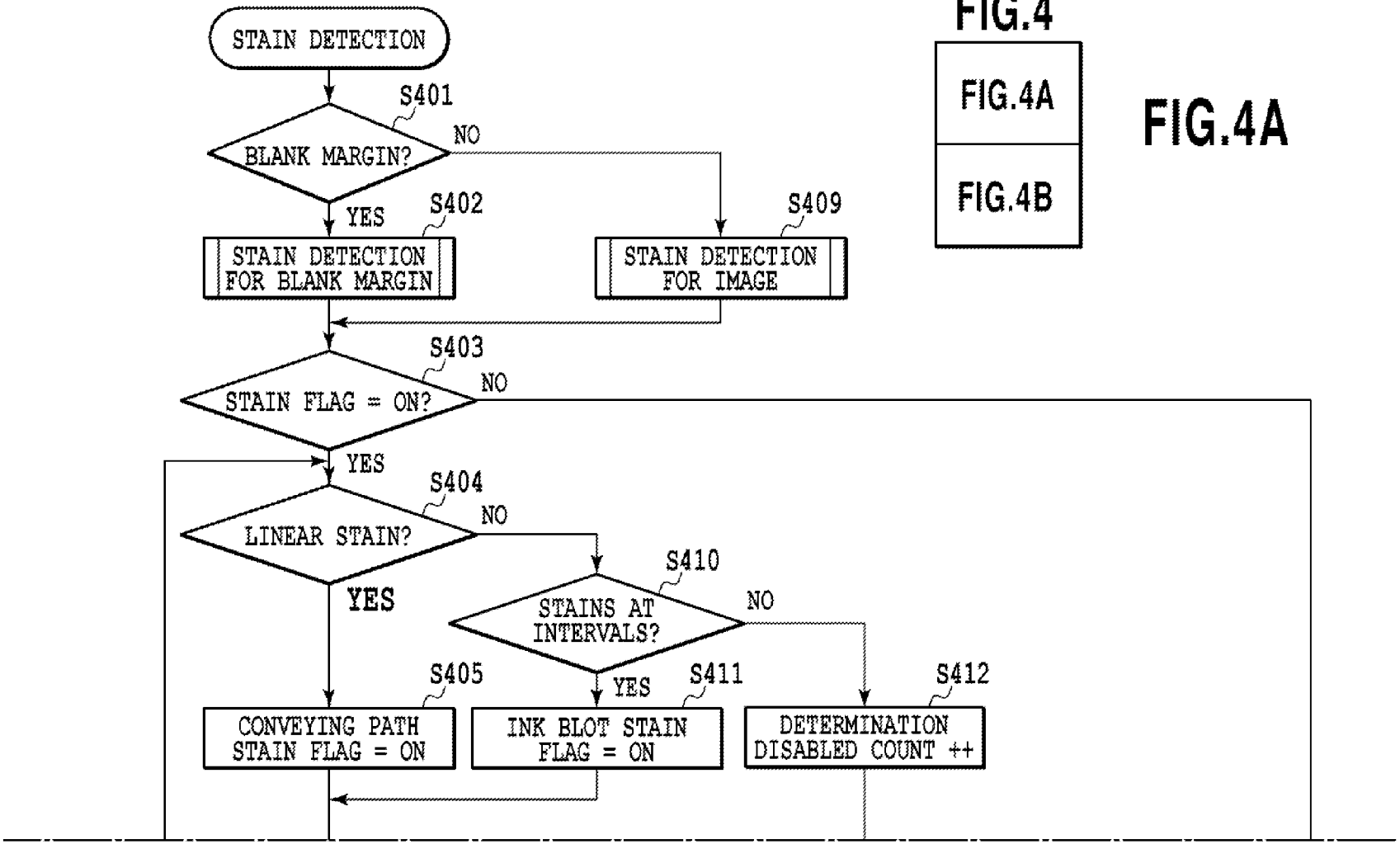
FIG. 4 is a diagram showing the relationship between FIGS. 4A and 4B.
FIGS. 4A and 4B are flowcharts showing the processing for detecting stains on a printed matter according to the first embodiment.
Figure 4B:
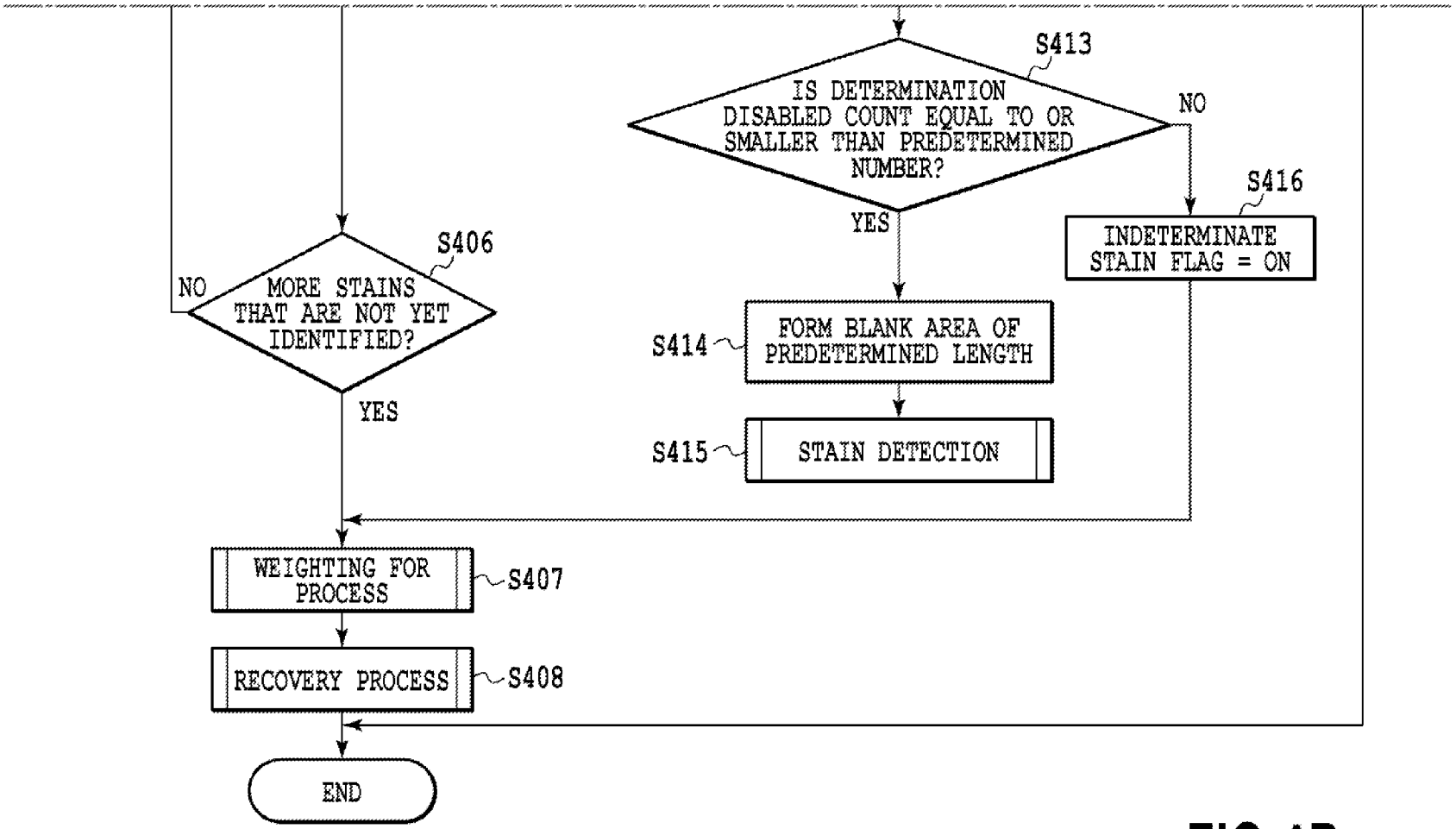

At step S403 in FIGS. 4A and 4B, in order to determine whether stains have been detected, a check is performed to determine whether the stain FLAG is ON. When the determination result is Yes, i.e., when stains have been detected at step S402 or at step S409, program control moves to step S404, and whether the stain is extended linearly is determined in order to specify the stain type. When the determination result at step S403 is No, i.e., when stains are not detected at step S402 or at step S409, the identification of the stain type and the recovery process are not required, and the stain detection process is terminated.

The individual FLAGs for a plurality of stain types that appear on the sheet will now be described. In the detection processing in this embodiment, weighting of the stain is performed in order to determine the priority to perform the recovery process with respect to the stain. Therefore, in the stain detection process, the individual stains are managed by using the FLAGs. In this embodiment, three stain FLAGs are employed. The first FLAG is an indeterminate stain FLAG that is to be set ON when indeterminate stains have occurred. The second FLAG is a conveying path stain FLAG that is to be set ON when stains are detected on the conveying path, as described above. The third FLAG is an ink blot stain FLAG that is to be set ON when ink blot stains have occurred by inadvertent dripping of ink blots from the print head unit 14, as described above. In this embodiment, these three stain FLAGs are prepared.

At step S404 and step S410, the shape of the stain is analyzed in order to identify the stain type. At step S404, a check is performed to determine whether the stain has a linear shape. An example stain in a linear shape (first stain) is shown in FIG. 11B. In a case wherein, as a result of the inspection unit 5, a linear stain is present on the printed face of the sheet, it can be ascertained that the stain is present along the conveying path. In a case wherein the stain is not linear, in this embodiment, the stain types can be narrowed down, i.e., it can be ascertained that the stain is either an ink blot stain, or an indeterminate stain. When the results for determining whether the stain is linear is Yes at step S404, it can be ascertained that the stain has appeared linearly, and is present along the conveying path, and at step S405, the conveying path stain FLAG is set ON, and program control advances to step S406. When the determination result at step S404 is No, it can be ascertained that no stain is present along the conveying path, and program control moves to step S410.

At step S410, since the stains have been detected at the previous steps, and are not identified as linear stains, a check is performed to determine whether the pertinent stains are attached at intervals. When the stains are attached on the sheet at the intervals, it can be ascertained that the stains are ink blot stains caused by advertent dripping of ink from the print head unit 14, as described above. Example stains attached at the intervals (second stains) are shown in FIG. 11C. When the determination result at step S410 is Yes, it can be ascertained that the stains present in the blank margin portions are those attached at the intervals, and are caused by dripping of ink-blots. Therefore, at step S411, the inkblot stain FLAG is set ON, and program control moves to step S406. When the determination result is No, it can be ascertained that the pertinent stains are not stains attached on the conveying path, or stains caused by dripping of ink blots, and program control advances to step S412.

At step S412, since the stains have been detected at the previous steps and are not the linear stains or the stains attached at the intervals, it is temporarily identified that the detected stains are indeterminate stains. In this embodiment, in a case wherein the number of times at which it is temporarily determined that the stains are indeterminate (hereinafter referred to as a determination disabled count) is equal to or greater than a predetermined count, it is ascertained that the pertinent stains are truly indeterminate stains. In this embodiment, the determination disabled count is incremented, and thereafter, program control advances to step S413.

At step S413, a check is performed to determine whether the determination disabled count is the predetermined count or smaller. An example indeterminate stain (third stain) is shown in FIG. 11D. In this stain detection process that will be explained later, the stain detection is repeated when stains the type of which can not be identified is detected. However, since conveying of the sheet is performed for re-detection, there is a possibility that the stains on the sheet will be attached to different portions of the conveying path, and will be expanded to the entire machine. Therefore, it is not preferable that the detection process be repeated. Therefore, the limited number of times is provided to perform the detection process, and when the process is repeated beyond the limited number of times, it is ascertained that the stains are indeterminate stains. As a result, it can be determined whether the detected stains are those for which the type can not be identified, and the deterioration of the condition due to unwanted performances of detection can be reduced. When the determination result at step S413 is No, i.e., the determination disabled count is greater than the predetermined count, program control moves to step S416, and the indeterminate stain FLAG is set ON. When the determination result at step S413 is Yes, i.e., the determination disabled count is equal to or smaller than the predetermined count, program control advances to step S414.

At step S414, since the stain type can not be identified at the previous steps, printing is performed for the blank area having a predetermined length, as described above. Thereafter, program control advances to step S415, and the stain detection process is performed again for the blank area that has been printed. Example stains detected in this process are shown in FIG. 11E. In the case of FIG. 11E, an image portion is a pattern printed with black color only, and the color of ink stains is also black. In this case, since the original image is black and the actually printed image is also black, the stains can not be distinguished from the image in the image portion, and therefore, the stains can not be detected. As for the blank margin portion, when ink has been applied to that area, it can be ascertained that some type of stains are present. However, in a case wherein the stains shown in FIG. 11E are detected only in the blank margin portion, it can not be identified whether the stains are those attached at the intervals, or linear stains extended across the image portion and the blank margin portion. Therefore, printing is performed for a blank area having a predetermined length, and the stain detection process is performed for the blank area, so that it can be ascertained that the stains are caused by blots of black ink attached at the intervals.

After the detection and identification of the stains attached on the sheet have been performed, at step S406, a check is performed to determine whether there are no more stains that are not yet detected. When there are such stains, it is assumed that a plurality of types of stains have occurred at the same time, and one or more types of stains that are not yet identified are present. When the determination result at step S406 is No, it is ascertained that a plurality of types of stains have occurred at the same time, and are not yet identified. In this case, program control returns to step S404 to identify the stain types again. When the determination result at step S406 is Yes, there are no more stains that are not yet identified, and program control advances to step S407. At step S407, the processing priority for the stains is determined, i.e., which stains should be employed first to perform the recovery process is determined. In accordance with the priority order, the recovery process at step S408 is performed.

Figure 8:
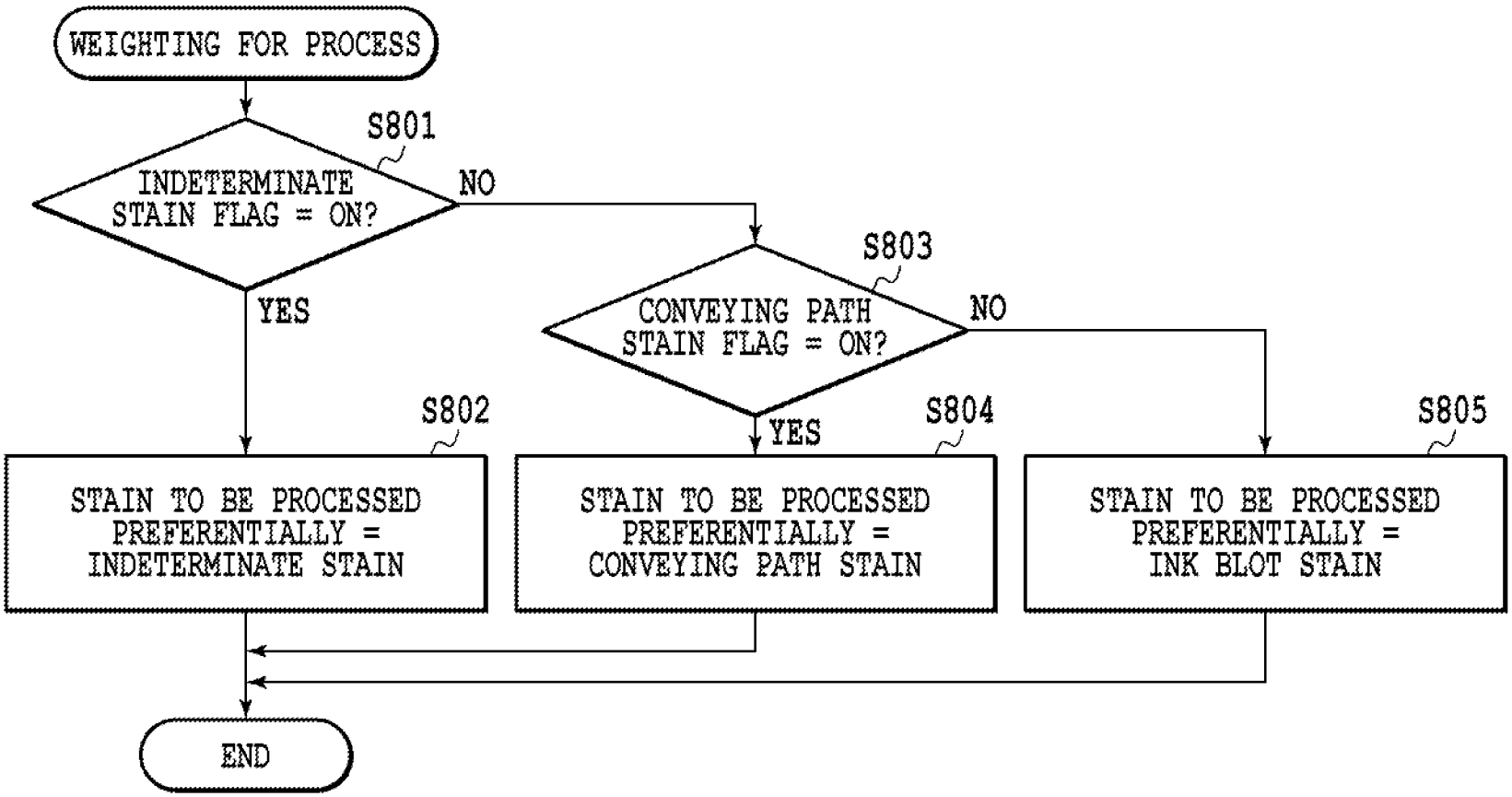
FIG. 8 is a flowchart showing the processing performed for the first embodiment to perform weighting for the process with respect to stains that have occurred in a printed matter.

As described above, the recovery process required to remove the cause of the stain differs depending on the types of stains attached to the sheet, and also, there are types of stains that may deteriorate the condition when the recovery process is performed. Therefore, at step S407, the process of weighting is performed in order to determine a priority for performing the recovery with respect to the detected stains. FIG. 8 is a flowchart showing the weighting process. In this embodiment, the level of the priority for the recovery process with respect to the stains is determined in the order of (1), (2) and (3) as follows.

(1) a process performed with respect to indeterminate stains, the cause of which can not be identified.

(2) conveying path stains that can not be removed by performing the recovery process for the print head unit 14 of this embodiment, and that may deteriorate the condition by performing the recovery process for the print head unit 14.

(3) ink blot stains, the cause of which is obtained, and which may be removed by performing the recovery process for the print head unit 14 of this embodiment.

At step S801 in FIG. 8, a check is performed to determine whether indeterminate stains are included in the stains that have been detected and indentified (step S801). This determination is performed by determining whether the indeterminate stain FLAG, which is employed to identify whether indeterminate stains have been detected, has been set ON. Since the cause of the indeterminate stain is not specified as described above, there is a possibility that the condition will be deteriorated by performing the recovery process regarded as the most difficult stains. When the determination result at step S801 is Yes, it is assumed that the indeterminate stains have been detected, and program control advances to step S802 to regard the indeterminate stains as those to be removed with the highest priority. When the determination result at step S801 is No, it is assumed that indeterminate stains are not detected, and program control moves to step S803 to determine whether conveying path stains that should be processed as the second highest priority have been detected.

At step S803, a check is performed to determine whether conveying path stains are present. This determination is performed by determining whether the conveying path stain FLAG, indicating that conveying path stains are detected, has been set ON. Since there is a possibility that the condition will be deteriorated by performing the recovery process for the print head unit 14, the conveying path stains are the second most difficult stains. When the determination result at step S803 is Yes, it is assumed that the conveying path stains are detected, and are regarded as being processed as the second highest priority. Therefore, program control advances to step S804, and the conveying path stains are regarded as those to be processed preferentially. When the determination result at step S804 is No, it is assumed that the conveying path stains are not detected, and that the remaining stain type is only ink blot stains. Thereafter, program control advances to step S805, and the stains are regarded as those to be processed preferentially. In this manner, weighting is performed for the processes with respect to the stains.

When weighting for the processes is completed, the recovery process is performed in accordance with the detected stains. The recovery process will now be described.

Figure 10:
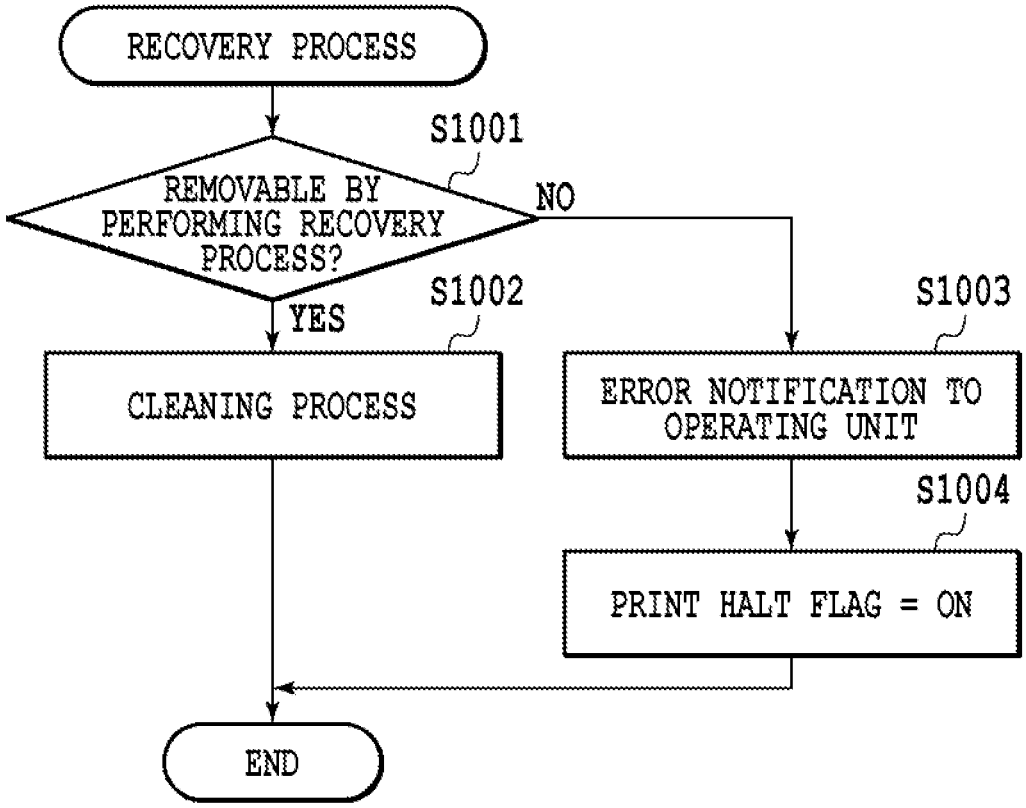
FIG. 10 is a flowchart showing a recovery process performed when stains have occurred on a printed matter.

As shown in FIGS. 4A and 4B, when the process of weighting described above has been performed at step S407, program control advances to step S408 to perform the recovery process. FIG. 10 is a flowchart showing the recovery process in FIG. 10. The recovery process to be performed for the print head unit 14 includes, as described above, the suction-based recovery process and the process for the ink ejection portions, such as a wiping process for cleaning the ejection face of the print head unit 14. Therefore, when these recovery processes are performed for indeterminate stains or conveying path stains, no results are provided, or adverse effects may be obtained. For example, in a case wherein the detected stains are conveying path stains, and wherein the sheet is conveyed to perform the wiping recovery process, the ink stains on the conveying path may be attached to the sheet, and in this state, the sheet may drag the ink stains along the conveying path. As a result, the stains will be expanded widely in the machine, and the condition will become worse. Therefore, in this embodiment, in a case wherein the indeterminate stains or conveying path stains have been detected, the recovery process for the print head unit 14 is not performed.

At step S1001 in FIG. 10, a check is performed to determine whether the stains, for which it is determined at step S407 the process should be performed preferentially, can be removed by performing the recovery process for the print head unit 14. As described above, when indeterminate stains or conveying path stains have been detected, there is a possibility that the condition will be deteriorated by performing the recovery process. Therefore, a determination is performed as to whether the recovery process should be performed for the print head unit 14, and when the determination result is Yes, it is ascertained that the stains to be processed as a priority are those by dripping of ink blots from the print head unit 14. The occurrence of the stains by dripping of ink blots can be removed by performing the recovery process for the print head unit 14. Therefore, at step S1002, the recovery process for the print head unit 14 is performed. In this embodiment, the stain type for which the recovery process for the print head unit 14 is required is only the stains caused by dripping of ink blots. Therefore, when the determination result at step S1001 is No, there is a possibility that the condition will be worse by performing the recovery process for the print head unit 14. In such a case, some user manipulations may be required, and at step S1003, an error notification is transmitted to the operating unit 15 in FIG. 1.

At step S1004, since the condition may be deteriorated by continuing the printing operation, the printing should be halted until the cause of the stains is removed. Therefore, the print halt FLAG described above is set ON, and thereafter, program control returns to the printing processing in FIG. 3, and continues the processing.

The individual steps of the flowcharts have been described. Next, the stain detection process for the five printed products shown in FIGS. 11B to 11F and the recovery process with respect to the detected stains will now be described for this embodiment.

First, the stain detection process for a printed product shown in FIG. 11B will be described. The stain on the printed product is the conveying path stain. As described above, the conveying path stain occurs in a case wherein ink is attached on the sheet conveying path indicated by the solid line in FIG. 2, and is then attached to the sheet. The stain tends to be extended linearly (see FIG. 11B). The stain detection process shown in FIGS. 4A and 4B, the blank margin stain detection process in FIG. 6, the image stain detection process in FIG. 7, the process weighting process in FIG. 8, and the recovery process in FIG. 10 will now be described in a case where in the conveying path stain has occurred.

At step S401 in FIGS. 4A and 4B, a check is performed to determine whether the currently examined portion of the sheet is a blank margin portion. When the currently examined portion is an image portion, program control moves to step S409, and the image stain detection process is performed. When the currently examined portion is a blank margin portion, program control advances to step S402, and the stain detection process for the blank margin portion is performed. At step S401, the first portion in the conveying direction is a first portion to be examined. In this case, since the printed product is as shown in FIG. 11B, and the first portion in the conveying direction is a blank margin portion, the blank margin portion is examined by the inspection unit 5. Thus, the determination result at step S401 is Yes, and program control advances to step S402 for the blank margin stain detection process in FIG. 6 to detect the stains in the blank margin portion.

In the process in FIG. 6, first, at step S601, a check is performed whether a printed portion is present. Referring to FIG. 11B, there is an ink attached portion in the first blank margin portion, and the inspection unit 5 detects the ink attached portion. Therefore, the determination result at step S601 is Yes, and program control moves to step S602 to set the stain FLAG ON. Thereafter, the margin detection process is terminated, and program control moves to step S403 in FIGS. 4A and 4B. At step S403 in FIGS. 4A and 4B, a check is performed to determine whether the stain FLAG is ON. Since the stain has been detected at the previous step and the stain FLAG is already ON, the determination result at step S403 is Yes, and program control advances to step S404. At step S404, a check is performed to determine whether the stain has a linear shape. Since the stain in the linear shape is attached in FIG. 11B, the determination results at step S404 is Yes, and program control advances to step S405 to set the conveying path stain FLAG ON.

Sequentially, program control moves to step S406, and a check is performed to determine whether there are any stains that are not yet identified. In FIG. 11B, since only the linear stain has occurred, the determination result at step S406 is YES, and program control advances to step S407. At step S407, the weighting for the process with respect to the stain is performed based on the processing shown in FIG. 8.

FIG. 8 is a flowchart showing the weighting for the process at step S407. At step S801 in FIG. 8, a check is performed to determine whether the indeterminate stain FLAG is ON. In FIG. 11B, since only the linear stain is present on the sheet, the determination result at step S801 is No, and program control moves to step S803. At step S803, a check is performed to determine whether the conveying path stain FLAG is ON. Since the conveying path stain FLAG has been set ON at step S405, the determination result at step S803 is Yes, and program control advances to step S804. Since the stains having a higher priority than the conveying path stains are not detected for the sheet in FIG. 11B, the conveying path stain is regarded as the stain to be processed as a priority. The weighting for the process is terminated, and program control moves to step S408 in FIGS. 4A and 4B, at which the recovery process is performed based on the flowchart in FIG. 10.

In the recovery process in FIG. 10, first, at step S1001, a check is performed to determine whether the occurrence of the detected stain can be prevented by performing the recovery process defined for this embodiment. As described above, there is a possibility that the conveying path stain will not be removed by the recovery process of this embodiment, such as cleaning, and the condition will be worse. Therefore, the determination result at step S1001 is No, and program control moves to step S1003. At step S1003, since it is ascertained at step S1001 that the stains can not be removed by performing the recovery process, an error notification is transmitted to the operating unit 15 in FIG. 1. Thereafter, program control advances to step S1004.

At step S1004, the print halt FLAG is set ON. As described above, the print halt FLAG is a FLAG employed to halt the printing operation even when there are more data to be printed. The reason for halting printing is, for example, that the range of stains would be expanded when printing is continued. The conveying path stain is produced in the manner that ink is attached to the conveying path, and when the sheet passes the ink attached portion of the conveying path, the ink is linearly attached to the sheet as it is conveyed. If printing is continued (conveying is continued) while the cause of the stain can not be removed, the stain of ink on the sheet may be attached to another portion of the conveying path. Therefore, in a case wherein the conveying path stain is detected, the print halt FLAG is set ON in order to halt printing. Thereafter, the stain detection, the type identification and the recovery process performed for the printed product in FIG. 11B are terminated.

The process for the printed product in FIG. 11C will now be described.

The stain detection, weighting for the process and the recovery process are also performed for the printed product in FIG. 11C. First, at step S401 in FIGS. 4A and 4B, a check is performed to determine whether the portion of the sheet currently examined by the inspection unit 5 is a blank margin portion or an image portion. Since examination begins with the first portion, the image portion is examined first. Therefore, when the determination at step S401 has been performed, program control moves to step S409, and the process for determining whether stains are present in the image portion is performed based on the flowchart in FIG. 7.

At step S701 in FIG. 7, an actually printed image is compared with a normal image without stains. In this embodiment, exclusive disjunction is employed to obtain a difference of the two images. In this case, since the normal image is the image portion in FIG. 11A, and there is a difference from the first image portion in FIG. 11C. Therefore, the result of the exclusive disjunction is 1 at step S701. At step S702, the comparison result at step S701 is employed to determine whether there is a difference between the normal image and the actually printed image. In this case, as the comparison at step S701, the result of exclusive disjunction is 1, and a difference is present. Therefore, the determination result at step S702 is Yes, and program control advances to step S703 to set the stain FLAG ON. Thereafter, the stain detection process for the image portion is terminated, and program control moves to step S403 in FIGS. 4A and 4B.

At step S403 in FIGS. 4A and 4B, a check is performed to determine whether the stain FLAG is ON. Since the stain FLAG has been set ON at step S703, the determination result is Yes, and program control advances to step S404. At step S404, a check is performed to determine whether the detected stains are formed in a linear shape. Since the stains at this time are those shown in the example in FIG. 11C, the stains are not in the linear shape. Therefore, the determination result at step S404 is No, and program control moves to step S410. At step S410, a check is performed to determine whether the detected stains are present at the intervals. According to the example in FIG. 11C, the individual stains are present at the intervals. Therefore, the determination result at step S410 is Yes, and program control advances to step S411 to set the ink blot stain FLAG ON. Thereafter, program control moves to step S406.

At step S406, a check is performed to determine whether there are more stains that are not yet identified. According to the example in FIG. 11C, since only the stains present at the intervals are detected, the determination result at step S406 is No, and program control advances to step S407 to perform weighting for the process. At step S407, the weighting for the process is performed based on the flowchart in FIG. 8. At step S801 in FIG. 7, a check is performed to determine whether the indeterminate stain FLAG is ON. According to the example in FIG. 11C, since indeterminate stains are not detected, the determination result is No, and program control moves to step S803. At step S803, a check is performed to determine whether the conveying path stain FLAG is ON. In this case, since the conveying path stains are not detected, the determination result at step S803 is No, and program control advances to step S805. Since only ink blot stains are detected for the example in FIG. 11C, at step S805, the ink blot stains are regarded as the stains to be processed preferentially. The weighting for the process is thereafter terminated, and program control moves to the recovery process at step S408 in FIGS. 4A and 4B.

At step S408, the recovery process for the detected stains is performed based on the flowchart in FIG. 10. At step S1001 in FIG. 10, a check is performed to determine whether the cause of the stains can be removed by performing the recovery process for the print head unit 14. As described above, the ink blot stains are caused by a defect of the ink ejection portions of the print head unit 14, and may be removed by performing the recovery process for the print head unit 14. Therefore, for the printed product shown in FIG. 11C, the determination result at step S1001 is Yes, and program control advances to step S1002. At step S1002, the recovery process for the print head unit 14 is performed. The recovery process here is a wiping process for cleaning the ejection face of the print head unit 14, or the suction-based recovery process for forcibly drawing ink from the nozzles. Through this process, the cause of the ink blot stains can be removed, and thereafter, the stain detection, the stain type identification and the recovery process with respect to the stain are terminated.

The process for the printed product shown in FIG. 11D will now be described.

For this printed product as well as the printed products described above, the stain detection, weighting for the process and the recovery process for the stains are performed. First, the stain detection process will be explained.

At step S401 in FIGS. 4A and 4B, a check is performed to determine whether a portion examined by the inspection unit 5 is a blank margin portion or an image portion. For the printed product in FIG. 11D, first, the blank margin portion is examined. Therefore, the determination result at step S401 is Yes, and program control advances to step S402.

At step S402, the stain detection for the blank margin portion is performed based on the flowchart in FIG. 6. In FIG. 6, at step S601, a check is performed to determine whether stains are present in the blank margin portion. Since the ink attached portions (stains) are present in the blank margin portion in FIG. 11D, the determination result is Yes, and program control moves to step S602 to set the stain FLAG ON. Thereafter, program control moves to step S403 in FIGS. 4A and 4B.

At step S403 in FIGS. 4A and 4B, a check is performed to determine whether the stain FLAG is ON. Since the ink attached portions (stains) are detected at steps S601 and S602, and the stain FLAG has been set ON, the determination result at step S403 is Yes, and program control advances to step S404. At step S404, a check is performed to determine whether the stains are in the linear shape. According to the printed product in FIG. 11D, the stains are not linearly extended. Therefore, the determination result at step S404 is No, and program control moves to step S410. At step S410, a check is performed to determine whether the stains are present at the intervals. Since the stains formed on the printed product in FIG. 11D are continuous, and are not present at the intervals, the determination result at step S410 is No, and program control moves to step S412.

At step S412, the count value at which the stain type can not be identified (determination disabled count) is incremented by one. For example, in a case wherein it is determined at the first time that stains are indeterminate, the determination disabled count at step S412 is a value of "1". Thereafter, program control advances to step S413. In this embodiment, the reference count of 1 is employed to determine that the determination disabled count should be the predetermined count or smaller. That is, in a case wherein stains can not be identified by performing detection two times, it is determined that the stains are indeterminate stains. At step S413, a check is performed to determine whether the determination disabled count is equal to or smaller than the predetermined count. In this example, since the determination disabled count is a value of 1, which is equal to or smaller than the predetermined value, the determination result at step S413 is Yes, and program control advances to step S414.

At step S414, a blank area having a predetermined length is formed. That is, the sheet is conveyed at a predetermined distance, while ejection of ink by the print head unit 14 is not performed. This is because the stain type can not be identified by the current stain detection, and there is a possibility that the stain type will be identified when the blank area is passed. For example, when an image is printed after the blank margin has been formed, the stain detection for this image is performed. In this case, since, although the type is not yet identified, the stains have been detected immediately before the image, there is a possibility that stains will occur also on the image portion, and an unsatisfactory printed product may be provided. Furthermore, in a case wherein stains of the same color as the image has occurred in the image portion, there is a possibility that it will be determined that no stains are found as the result of detection. However, when stain detection is performed for a blank area, simply the presence of the ink attached portion need be detected to determine whether stains have occurred in the blank area. Therefore, in a case wherein the stain type can not be identified, a blank area is formed. The blank area is an area where no images are printed. Thereafter, at step S415, the stain detection process is performed again for the blank area, and therefore, program moves to step S401.

At step S401, a check is performed to determine whether a portion currently examined is a blank margin portion or not. Since the portion is a blank area, the determination result is Yes. Then, at step S402, the stain detection for the blank margin is performed. For the stain detection for the blank margin, the flowchart in FIG. 6 is employed. Since ink attached portions are present on the printed product in FIG. 11D, the determination result at step S601 is Yes, and at step S602, the stain FLAG is set ON. Sequentially, at step S403, a check is performed to determine whether the stain FLAG is ON. Since the stain FLAG has been set ON at step S602 in FIG. 6, the determination result is Yes. At step S404, a check is performed to determine whether the stains are extended linearly. Since the stains in FIG. 11D can not be identified as linear stains by performing the detection for the blank area, the determination result at step S404 is No, and program control moves to step S410.

At step S410, a check is performed to determine whether the stains are formed at the intervals. However, since the stains in FIG. 11D can not be identified as those present at the intervals, the determination result at step S410 is No, and program control moves to step S412. At step S412, since the stain type can not be specified at the previous steps, the determination disabled count is incremented. Since this process is the second detection, the determination disabled count is 2.

Following this, program control moves to step S413, and a check is performed to determine whether the determination disabled count is equal to or smaller than the predetermined value. As described above, in this embodiment, a reference value of 1 is employed for determining whether the determination disabled count is the predetermined number or smaller. That is, in a case wherein the stain type can not be identified by performing the detection twice, it is ascertained that the stains are indeterminate stains. Since the determination disabled count at this step is 2, this value is greater than the predetermined value. Therefore, the determination result at step S413 is No, and program control moves to step S416. At step S416, the indeterminate stain FLAG is set ON to store information indicating that the indeterminate stains have been detected, and program control moves to step S407 to perform weighting for the process.

At step S407, weighting for the process is performed based on the flowchart in FIG. 8. At step S801, a check is performed to determine whether the indeterminate stain FLAG is ON. Since the indeterminate stain FLAG has been set ON at step S416, the determination result is Yes, and program control moves to step S802. At step S802, among the stains detected in the currently performed stain detection process, indeterminate stains are regarded as the stains to be processed as a priority, and thereafter, weighting for the process is terminated.

Thereafter, program control moves to the recovery process performed at step S408 with respect to the stains. FIG. 10 is a flowchart showing the recovery process. At step S1001 in FIG. 10, a check is performed to determine whether the cause of the stains can be removed by performing the recovery process for the print head unit 14. Since the cause of the indeterminate stains detected at this time can not be specified, the stains can not be removed by the recovery process for the print head unit 14. Therefore, the determination result at step S1001 is No, and program control moves to step S1003.

At step S1003, the occurrence of the indeterminate stains is displayed on the operating unit 15 to notify the user of that effect. At step S1004, the print halt FLAG is set ON. As described above, the print halt FLAG is employed to halt the printing operation even when there are more data to be printed. The reason for halting the printing is, for example, that the range of stains may be expanded by continuing printing. The conveying path stain is the one produced in the manner that ink is attached to the conveying path, and is thereafter transferred to the sheet and extended linearly when the sheet passes the ink attached portion of the conveying path. If printing is continued (conveying is continued) while the cause of the stain can not be removed, the stain of ink on the sheet may be attached to another portion of the conveying path. Therefore, in a case wherein the conveying path stain is detected, the print halt FLAG is set ON in order to halt printing. Thereafter, the stain detection, the type identification and the recovery process performed for the printed product in FIG. 11D are terminated.

Next, a case wherein a printed product in FIG. 11E is obtained will be described. For this case as well as the other printed products, the stain detection and the recovery process with respect to the stains will be described. The example in FIG. 11E shows that, when printing of an image with black color was performed, dripping of ink blots of the same black color occurred.

At step S401 in FIGS. 4A and 4B, a check is performed to determine whether a currently examined portion is a blank margin portion or an image portion. According to the printed product in FIG. 11E, since the first portion is an image and the portion currently detected is also an image, the determination result is No, and program control moves to step S409. Then, the image stain detection process is performed based on the flowchart in FIG. 7.

FIG. 7 is a flowchart showing the image stain detection process. At step S701 in FIG. 7, an actually printed image is compared with the normal image. According to the printed product in FIG. 11E, stains have actually occurred; however, as described above, when an image is printed with black color only, and the color of the stains is also the same color, a difference of the two can not be detected by performing the image stain detection. Therefore, at the succeeding step S702, it is determined that no difference is present between the two images, and the determination result at step S702 is No. Thereafter, the image stain detection process is terminated, and program control moves to step S403 in FIGS. 4A and 4B. At step S403, a check is performed to determine whether the stain FLAG is ON. Since stains were not detected in the image stain detection processes at the previous step, and the stain FLAG is not set ON, the determination result at step S403 is No, and the stain detection process is terminated.

Following this, the stain detection is performed for the portion that passes by the inspection unit 5. At step S401 in FIGS. 4A and 4B, a check is performed to determine whether a currently examined portion is a blank margin portion. According to the printed product in FIG. 11E, since the second portion to be examined is a blank margin portion, the determination result is Yes, and program control advances to step S402, whereat the stain detection for the blank margin is performed based on the flowchart in FIG. 6. At step S601 in FIG. 6, a check is performed to determine whether ink attached portions (stains) are present in the examined portion. Since stains are present on the printed product in FIG. 11E, the determination result at step S601 is Yes, and at step S602, the stain FLAG is set ON and thereafter, program control moves to step S403 in FIGS. 4A and 4B.

At step S403, a check is performed to determine whether the stain FLAG is ON. In this case, since the stain FLAG ahs been set ON at step S602, the determination result is Yes, and program control advances to step S404. At step S404, a check is performed to determine whether the detected stains are in the linear shape. According to the printed product in FIG. 11E, the stains are not extended linearly. Therefore, the determination result is No, and program control moves to step S410. At step S410, a check is performed to determine whether the detected stains are stains formed at the intervals, or continuous stains. According to the printed product in FIG. 11E, whether the stains are present at the intervals can not be identified only by employing the blank margin portion. Therefore, the determination result at step S410 is No, and program control moves to step S412. At step S412, the determination disabled count is incremented by one. In this case, since it is the first time that the stains are identified as indeterminate stains, the determination disabled count is a value of 1 at this step. Program control thereafter moves to step S413. In this embodiment, the reference value of 1 is employed to determine whether the determination disabled count is equal to or smaller than the predetermined value. That is, in a case wherein the stain type can not be identified by performing the detection process twice, it is ascertained that the stains are indeterminate stains.

At step S413, a check is performed to determine whether the determination disabled count is equal to or smaller than the predetermined value. Since this is the first detection process, the determination result is Yes, and program control advances to step S414. At step S414, the blank area having a predetermined length is passed, with respect to the print head unit 14. This is because, as described for the example in FIG. 11C, even when the stain type is not identified by the stain detection, there is a possibility that, when the blank area is passed, the stain type may be identified. This method is effective for a printed product, as shown in FIG. 11E, wherein the same color is employed for the stains and the portion where stains have occurred. At step S415, the stain detection is performed again for the blank area, and therefore, program control moves to step S401.

As described above, at step S401, a check is performed to determine whether the currently examined portion is a blank margin portion, and since the blank area is currently examined, the determination result is Yes. At step S402, the stain detection for the blank margin is performed. Since ink stains are present at step S402, the determination result at step S601 in FIG. 6 is Yes, and at step S602, the stain FLAG is set ON. Sequentially, at step S403, a check is performed to determine whether the stain FLAG is ON. Since the stain FLAG has been set ON at step S602 in FIG. 6, the determination result at step 403 is Yes.

At step S404, a check is performed to determine whether the stains are extended linearly. Since the stains in FIG. 11E can not be identified as linear stains even by performing the detection for the blank area, the determination result at step S404 is No, and program control moves to step S410. At step S410, a check is performed to determine whether the stains are formed at the intervals. Since the detection process at this time is performed for the blank area, and the stains in the example in FIG. 11E can be identified as those formed at the intervals, the determination result at step S410 is Yes, and program control advances to step S411. At step S411, the ink blot stain FLAG is set ON, and program control moves to step S406.

At step S406, a check is performed to determine whether there are stains that are not yet identified. Since all the stains detected are the stains formed at the intervals, the determination result at step S406 is No, and program control advances to step S407 to perform weighting for the process based on the flowchart in FIG. 8. In FIG. 8, at step S801, a check is performed to determine whether the determination disabled FLAG is ON. In this embodiment, since indeterminate stains are not detected, the determination result is No, and program control moves to step S803. At step S803, a check is performed to determine whether the conveying path stain FLAG is ON. Since conveying path stains are not detected at this time, the determination result is No, and program control moves to step S805, whereat ink blot stains are regarded as those to be processed as a priority. The weighting for the process is thereafter terminated, and program control moves to the recovery process at step S408 in FIGS. 4A and 4B.

FIG. 10 is a flowchart for the recovery process with respect to the detected stains. At step S1001, a check is performed to determine whether the cause of the detected stains can be removed by performing the recovery process for the print head unit 14. As described above, ink blot stains are caused by the defect of the ink ejection portion of the print head unit 14, and may be removed by performing the recovery process for the print head unit 14. Therefore, in a case wherein the printed product is the one shown in FIG. 11E, the determination result at step S1001 is Yes, and program control advances to step S1002 to perform the recovery process for the print head unit 14. Through the recovery process, the cause of ink blot stains is removed, and thereafter, the stain detection, the stain type identification and the recovery process with respect to the stains are terminated. As described above, for stains that could not be identified at first by employing the normal print pattern, the stain detection should be performed again by forming a blank area, so that the stain type may be determined.

Figure 11F:
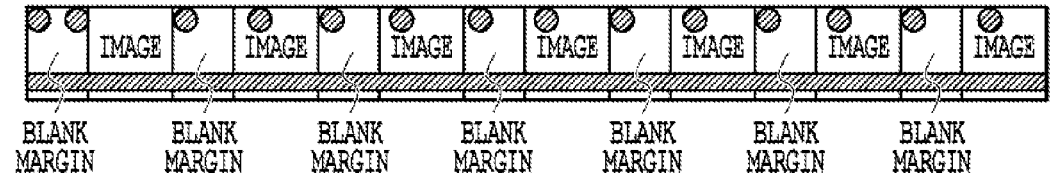

Next, the process for the printed product in FIG. 11F will be described. The printed product here is provided in a case wherein both conveying path stains and ink blot stains have occurred. As for the printed product as well as the other printed products, the stain detection and the recovery process with respect to the stains will be described. At step S401 in FIGS. 4A and 4B, a check is performed to determine whether the portion of the sheet currently examined is a blank margin portion. Since the first portion of the printed product in FIG. 11F is a blank margin portion, the determination result is Yes, and program control moves to step S402, at which the stain detection for the blank margin is performed based on the flowchart in FIG. 6.

Since this process is the stain detection for the blank portion, at step S601 in FIG. 6, a check is performed to determine whether ink attached portions (stains) are present. Since ink is attached to the blank margin in FIG. 11F, the determination result is Yes, and program control moves to step S602 to set the stain FLAG ON. Then, program control moves to step S403 in FIGS. 4A and 4B. At step S403 in FIGS. 4A and 4B, a check is performed to determine whether the stain FLAG is ON. Since the ink attached portion was detected at steps S601 and S602, and the stain FLAG has been set ON, the determination result is Yes, and program control advances to step S404. At step S404, a check is performed to determine whether the stain is in the linear shape. Since the linear stain is attached on the printed product in FIG. 11F, the determination result is Yes, and program control advances to step S405 to set the conveying path stain FLAG ON.

Sequentially, program control moves to step S406, and a check is performed to determine whether there are stains that are not yet identified. Since stains other than the linear stain have occurred in FIG. 11F, the determination result is Yes, and program control returns to step S404 to determine again the stain type for the pertinent stain. At step S404, a check is performed to determine whether the stain is linearly extended. Since the linear stain in FIG. 11F has been already identified, identification is performed for another type of stains. Since these stains are not linear, program control moves to step S410. At step S410, a check is performed to determine whether the stains are present at the intervals. Since it can be ascertained that the stains for the example in FIG. 11F are formed at the intervals, the determination result at step S410 is Yes, and program control advances to step S411. At step S411, the ink blot stain FLAG is set ON, and program control moves to step S406. At step S406, a check is performed to determine whether there are more stains that are not yet identified. According to the example in FIG. 11F, since two types of stains, i.e., the linear stain and the stains formed at the intervals, are detected and another stain type is not detected, the determination result at step S406 is No, and program control advances to step S407. At step S407, weighting for the process is performed based on the flowchart in FIG. 8.

First, at step S801, a check is performed to determine whether the indeterminate stain FLAG is ON. According to the example in FIG. 11F, since the indeterminate stains are not detected, the determination result is No, and program control moves to step S803. At step S803, a check is performed to determine whether the conveying path stain FLAG is ON. Since the conveying path stain FLAG has been set ON at step S405, the determination result at step S803 is Yes, and program control advances to step S804. At this time, ink blot stains are also detected, and the conveying path stains regarded as a higher priority are also detected. Furthermore, since stains having a higher priority than the conveying path stains are not detected, at step S804, the conveying path stains are regarded as stains to be processed preferentially. The weighting for the process is thereafter terminated, and program control moves to step S408 in FIGS. 4A and 4B, at which the recovery process is performed based on the flowchart in FIG. 10.

At step S1001 in FIG. 10, a check is performed to determine whether the detected stains can be removed by performing the recovery process defined in this embodiment. Among the detected stain types, ink blot stains may be removed by performing the recovery process for the print head unit 14. However, as described above, there is a possibility that the conveying path stains will not be removed by the recovery process for this embodiment, such as cleaning, and the stain condition will be worse. Therefore, the determination result at step S1001 is No, and program control moves to step S1003. At step S1003, since it is ascertained at step S1001 that the stains can not be removed by cleaning the print heads, an error notification is transmitted to the operating unit 15 in FIG. 2. Thereafter, program control moves to step S1004.

At step S1004, the print halt FLAG is set ON. As described above, the print halt FLAG is employed to halt printing even when there are more data to be printed. The reason for halting the printing is that the range of stains would be expanded by continuing the printing operation. The conveying path stain is the one produced in the manner that ink is attached to the conveying path, and is transferred to the sheet and linearly extended when the sheet passes the ink attached portion of the conveying path. If printing is continued (conveying is continued) while the cause of the stain can not be removed, the stain of ink on the sheet may be attached to another portion of the conveying path. Therefore, in a case wherein the conveying path stain is detected, the print halt FLAG is set ON in order to halt printing. Thereafter, the stain detection, the type identification and the recovery process performed for the printed product in FIG. 11F are terminated.

Second Embodiment

A second embodiment according to the present invention will now be described. In the second embodiment, ink blot stains, conveying path stains and indeterminate stains and other stains can be processed. That is, unlike in the first embodiment, the stain types are not limited for this embodiment, and the method for this embodiment can be employed for a case wherein N types of stains (N is one or more) are present. The arrangement and the operation for this embodiment are the same as those for the first embodiment, except for the processing in FIGS. 4A, 4B and 8. Therefore, only a difference from the first embodiment will be mainly described.

Figures 5, 5A:
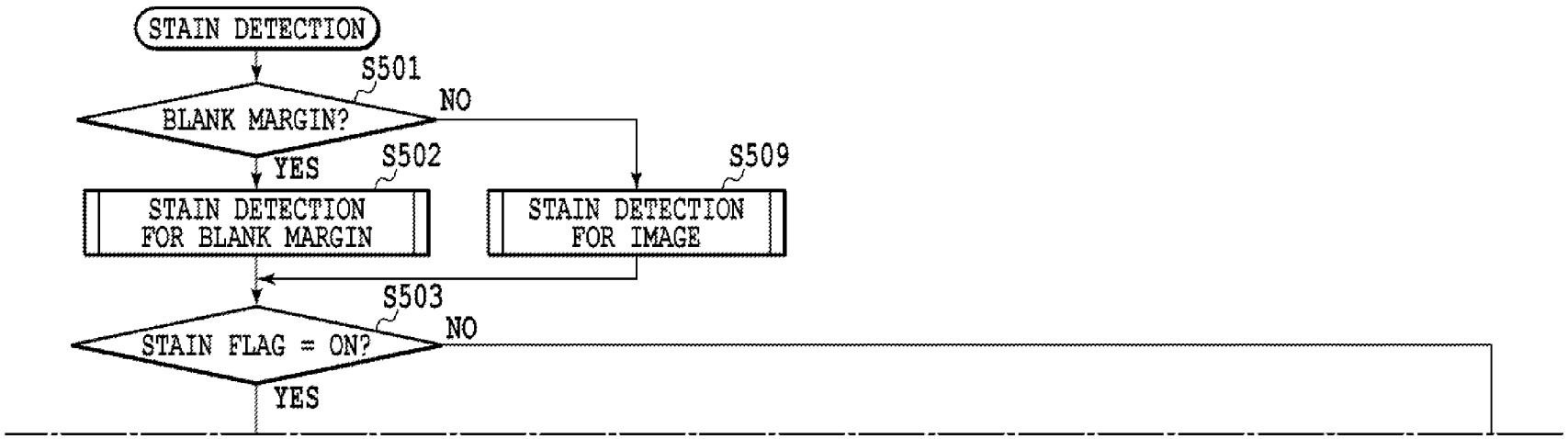
FIG. 5 is a diagram showing the relationship between FIGS. 5A and 5B.
FIGS. 5A and 5B are flowcharts showing the processing for detecting stains on a printed matter according to the second embodiment.
Figure 5B:
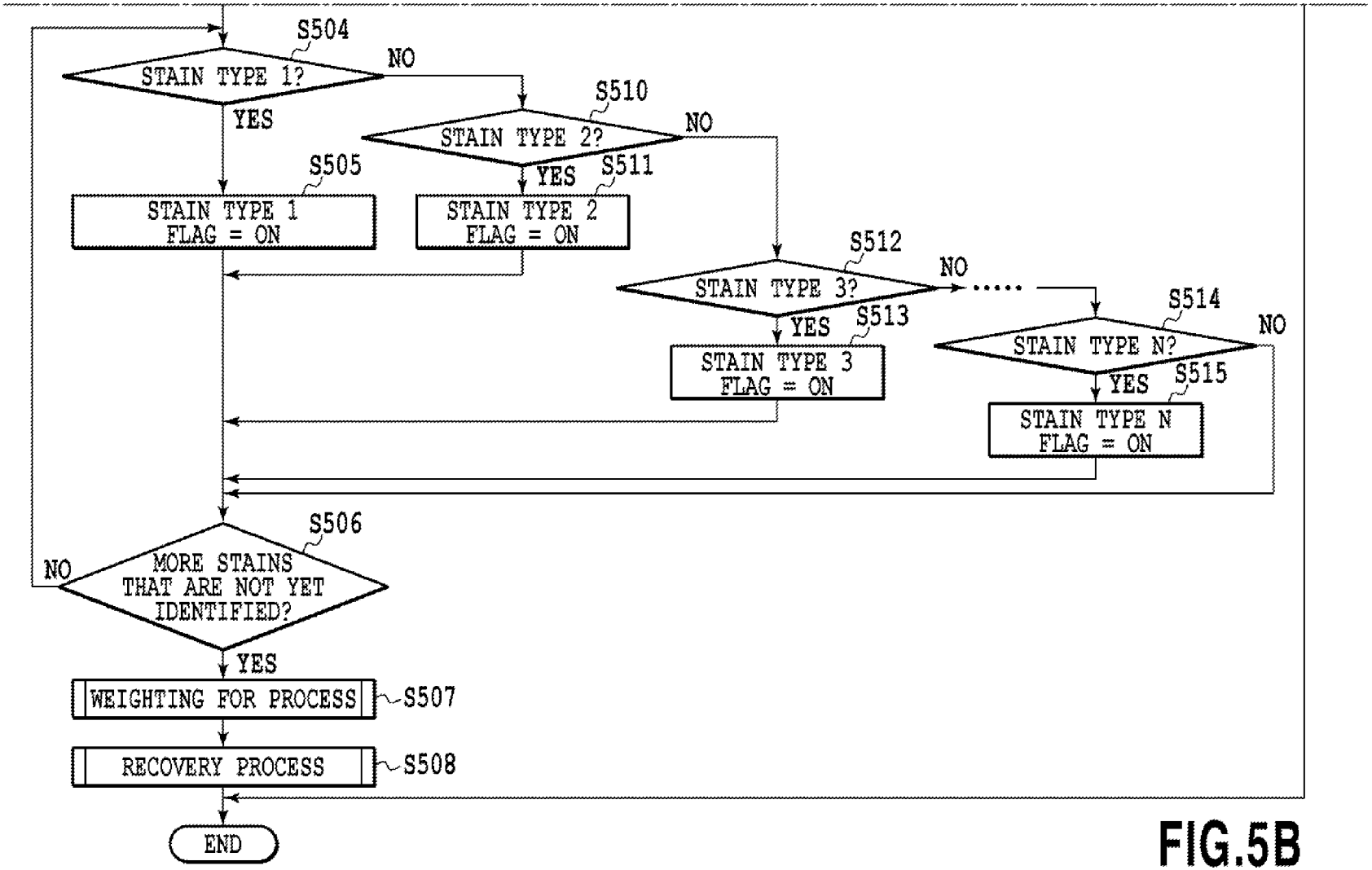

For the second embodiment, the stain detection process at step S303 in FIG. 3 is performed based on a detection flowchart in FIGS. 5A and 5B. Since steps S501, S502, S503 and S509 in FIGS. 5A and 5B are the same as those for the first embodiment, no further explanation for them will be given.

At step S504, a check is performed to determine whether the type of the detected stains is stain type 1. When the determination result is Yes, at step S505, a stain type 1 FLAG is set ON. When the determination result is No, program control moves to step S510. At step S510, a check is performed to determine whether the detected stain type is a stain type 2. When the determination result is Yes, at step S511, a stain type 2 FLAG is set ON. When the determination result is No, program control moves to step S512.

The determination for the stain type is repeated by the number of times equivalent to the number of stain types, and when the determination result is Yes, a pertinent FLAG is set ON.

At step S506, as well as in the first embodiment, a check is performed to determine whether there are stains that are not yet identified. When the determination result is Yes, the stain type determination is repeated beginning at step S504. When the determination result at step S506 is No, program control advances to step S507, and weighting for the process is performed based on the flowchart in FIGS. 9A and 9B.

Figures 9, 9A:
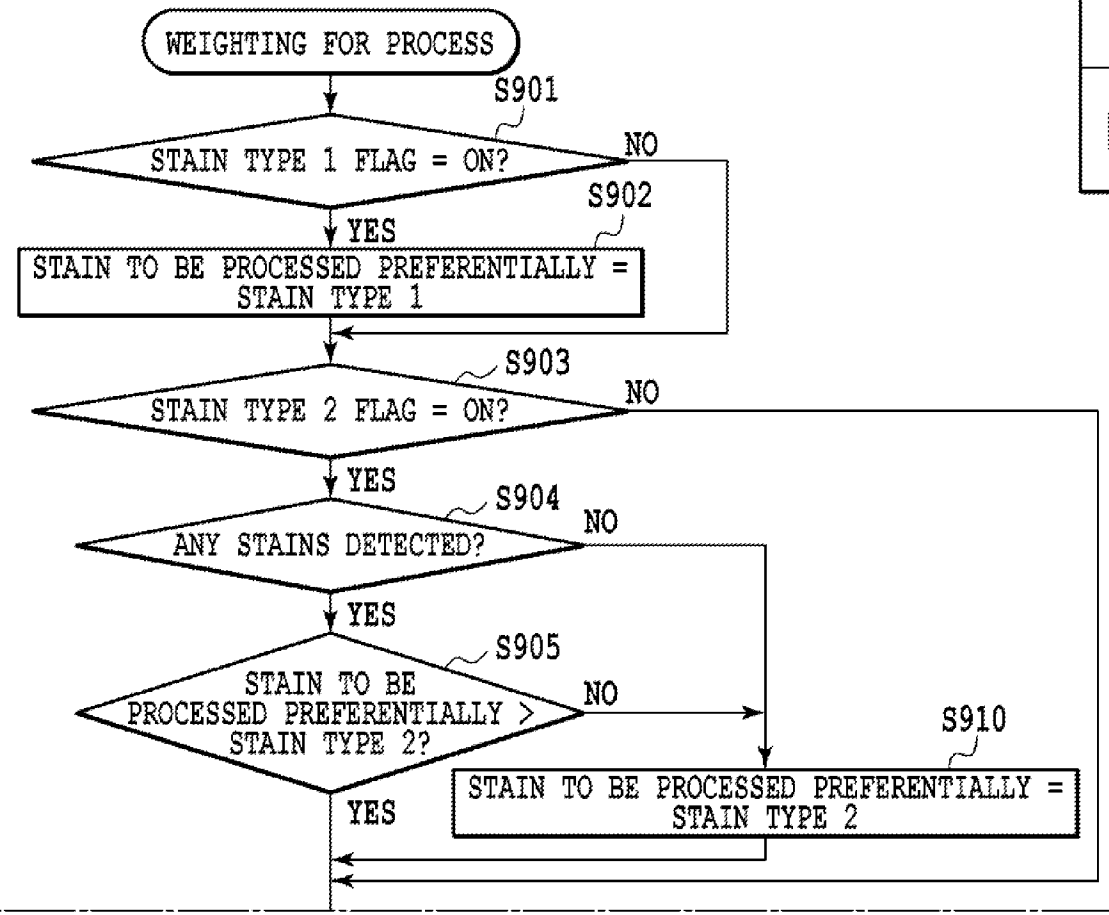
FIG. 9 is a diagram showing the relationship between FIGS. 9A and 9B.
FIGS. 9A and 9B are flowcharts showing the processing performed for the second embodiment to perform weighting for the process with respect to stains that have occurred in a printed matter.
Figure 9B:
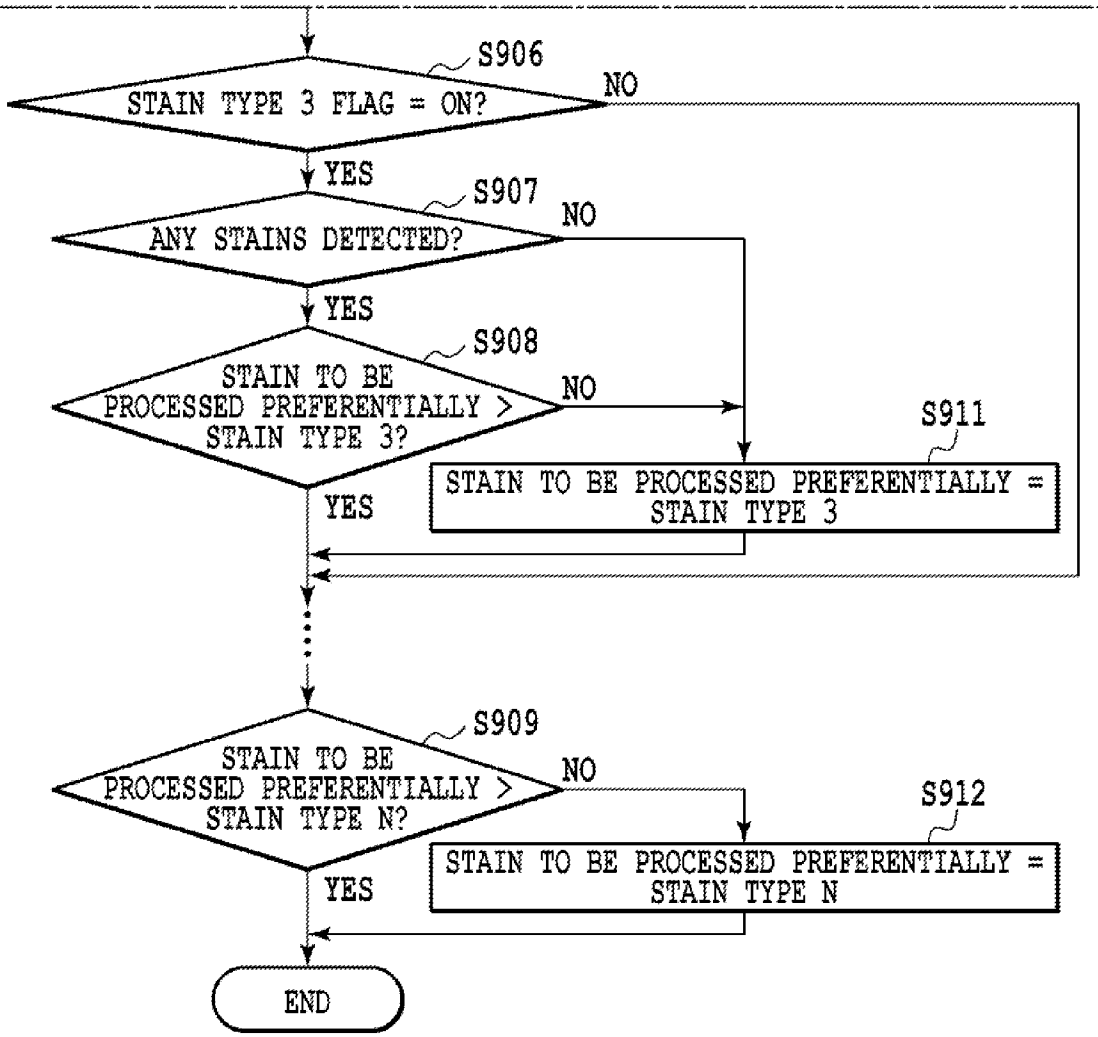

In FIGS. 9A and 9B, at step S901, a check is performed to determine whether the stain type 1 FLAG is ON. When the determination result is Yes, at step S902, the stain of stain type 1 is regarded as the stain to be processed preferentially, and program control moves to step S903. When the determination result at step S902 is No, program control advances to step S903. At step S903, a check is performed to determine whether the stain type 2 FLAG is ON. When the determination result is Yes, program control moves to step S904, or when the determination result is No, program control moves to step S906.

At step S904, a check is performed to determine whether there are the stain FLAGs that have been set ON. When the determination result is Yes, program control advances to step S905. When the determination result is No, program control moves to step S910, and the stain of stain type 2 is regarded as the stain to be processed preferentially. Program control thereafter moves to step S906.

At step S905, a check is performed to determine whether the stain of stain type that is currently regarded as the stain to be processed preferentially is more difficult stain than the stain type 2. When the determination result is Yes, the priority given for the stain to be processed is unchanged, and program control moves to step S906.

The above described processing is repeated by the number of times equivalent to the number of stain FLAGs that are ON, and the stain type for the most difficult stain is determined, and is regarded as the stain to be processed as a priority. Thereafter, program control moves to step S508 in FIGS. 5A and 5B, and the recovery process is performed. The process at step S508 is the same as that for the first embodiment, and no further explanation for this will be given.

As described above, according to the second embodiment, even when stains other than ink blot stains and conveying path stains are present, these stains can be coped with.

The present invention can be applied also for a printing apparatus that forms an image on a cut sheet that is prepared in advance, or a cut sheet obtained by cutting a sheet roll along a conveying path before reaching print heads. The present invention can also be applied for a so-called serial type printing apparatus that performs printing by moving print heads in a direction perpendicular to the sheet conveying direction. Further, the present invention can also be applied for a so-called roll-to-roll type printing apparatus that rewinds the printed sheet around a roll, without cutting the printed sheet from the roll. In this case, even when stains have occurred during the printing operation, the stain detection device of the present invention and the printing apparatus equipped with this device can appropriately perform the recovery process in accordance with the stain type, and as a result, a waste of the rolled sheet and printed products can be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169432, filed Jul. 31, 2012, which is hereby incorporated by reference herein in its entirety.

What is claimed is:

1. A printing apparatus comprising:

a printing unit configured to form an image based on image data on a surface of a recording medium by ejecting ink from a print head;

a reading unit configured to read the surface where the image is formed;

a control unit configured to determine a type of stain based on the read data obtained by the reading unit; and a recovery unit configured to perform a recovery process for the print head, wherein the control unit is further configured to cause a notification that a recovery operation by a user is required in a case where it is determined that the type of stain is a first type for which the recovery operation by the user is required, and to cause the recovery unit to perform the recovery process for the print head in a case where it is determined that the type of stain is a second type for which the recovery operation by the user is not required.

2. The printing apparatus according to claim 1, wherein the first type that forms a linear shape and the second type where stains are present at intervals.

3. The printing apparatus according to claim 1, wherein in a case where the print surface has a plurality of different types of stains, a stain having a higher priority is to be processed.

4. The printing apparatus according to claim 1, further comprising:

a determination unit configured to perform different determination processes depending on whether an area of the surface read by the reading unit is a blank margin or an image.

5. The printing apparatus according to claim 1, wherein the recording medium is a continuous sheet.

6. The printing apparatus according to claim 1, wherein the recovery unit is further configured to perform a cleaning process for the print head.

7. The printing apparatus according to claim 1, wherein the control unit is further configured to identify, based on the result of the comparison of the read data with the image data, a portion in which a problem occurs, and determine whether the recovery process should be performed based on the identified portion.

8. A printing method comprising:

a printing step of forming an image based on image data on a surface of a recording medium by ejecting ink from a print head;

a reading step of reading the surface where the image is formed;

a control step of determining a type of stain based on the read data obtained in the reading step; and a recovery determination step of causing a notification that a recovery operation by a user is required in a case where it is determined that the type of stain is a first type for which the recovery operation by the user is required, and of causing the recovery step to perform the recovery process for the print head in a case where it is determined that the type of stain is a second type for which the recovery operation by the user is not required.

9. The printing method according to claim 8, wherein the recording medium is a continuous sheet.

10. The printing method according to claim 8, wherein the recovery process performs a cleaning process for the print head.

11. The printing method according to claim 8, wherein the control step further identifies, based on the result of the comparison of the read data and the image data, a portion in which a problem occurs, and whether the recovery process should be performed is determined, in the recovery determination step, based on the identified portion.

* * * * *